US006668684B2

(12) United States Patent
Allen et al.

(10) Patent No.: US 6,668,684 B2
(45) **Date of Patent: *Dec. 30, 2003**

(54) TONG FOR WELLBORE OPERATIONS

(75) Inventors: John Timothy Allen, Katy, TX (US); Steven Anthony Box, Katy, TX (US); Bernd Pietras, Wedemark (DE); Jeffrey Michael Habetz, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 17 days.

This patent is subject to a terminal disclaimer.

(21) Appl. No.: 10/011,049

(22) Filed: Dec. 7, 2001

(65) Prior Publication Data

US 2002/0134555 A1 Sep. 26, 2002

Related U.S. Application Data

(62) Division of application No. 09/524,773, filed on Mar. 14, 2000, now Pat. No. 6,412,554.

(51) Int. Cl.[7] ..... B25B 17/00

(52) U.S. Cl. ..... 81/57.15; 81/57.19; 81/57.21; 173/216

(58) Field of Search ..... 81/57.15, 57.19, 81/57.21, 57, 57.38, 57.44, 301, 57.33, 57.37, 120, 430; 269/25, 150, 287; 173/1, 216, 218, 164; 166/77.51, 85.1; 73/862.25; 175/195

(56) References Cited

U.S. PATENT DOCUMENTS

| | | | | | |
|---|---|---|---|---|---|
| 1,386,908 | A | | 8/1921 | Taylor | |
| 1,842,638 | A | | 1/1932 | Wigle | |
| 2,214,194 | A | | 9/1940 | Frankley | |
| 2,214,429 | A | | 9/1940 | Miller | 166/16 |
| 2,522,444 | A | | 9/1950 | Grable | 166/16 |
| 2,610,690 | A | | 9/1952 | Beatty | 166/16 |
| 2,950,639 | A | * | 8/1960 | Mason | 81/57.18 |
| 3,021,739 | A | * | 2/1962 | Grudnmann | 81/57.19 |
| 3,041,901 | A | | 7/1962 | Knights | |
| 3,086,413 | A | * | 4/1963 | Mason | 81/57.16 |
| 3,122,811 | A | | 3/1964 | Gilreath | 24/263 |
| 3,131,586 | A | | 5/1964 | Wilson | |
| 3,180,186 | A | * | 4/1965 | Catlan | 81/57.18 |
| 3,220,245 | A | | 11/1965 | Winkle | |
| 3,302,496 | A | | 2/1967 | Mitchell et al. | |
| 3,349,455 | A | | 10/1967 | Doherty | |
| 3,443,291 | A | | 5/1969 | Doherty | |
| 3,475,038 | A | | 10/1969 | Matherne | |
| 3,518,903 | A | | 7/1970 | Ham et al. | |
| 3,559,739 | A | | 2/1971 | Hutchison | 166/311 |
| 3,680,412 | A | | 8/1972 | Mayer et al. | |

(List continued on next page.)

FOREIGN PATENT DOCUMENTS

| | | | | |
|---|---|---|---|---|
| DE | 2128 362 | * | 1/1972 | E21B/19/00 |
| EP | 0 285 386 | | 5/1988 | E21B/19/16 |
| EP | 0 339 005 | | 10/1989 | E21B/19/16 |

(List continued on next page.)

*Primary Examiner*—Joseph J. Hail, III
*Assistant Examiner*—Hadi Shakeri
(74) *Attorney, Agent, or Firm*—Moser, Patterson & Sheridan, L.L.P.

(57) ABSTRACT

A tong as may be used for a continuous circulation system in a wellbore. The tong has a housing with a hollow interior. A plurality of spaced apart jaw assemblies reside within the housing's hollow interior for engaging a portion of a tubular to be gripped and rotated by the tong. A gear wheel is secured to the housing for rotating the housing and the jaw assemblies. The gear wheel includes a toothed outer circumference for mating with teeth of a drive shaft of a driving motor. A gear flange is movably mounted on the gear wheel such that rotation of the gear wheel does not rotate the gear flange.

25 Claims, 29 Drawing Sheets

U.S. PATENT DOCUMENTS

| | | | | | |
|---|---|---|---|---|---|
| 3,722,331 | A | | 3/1973 | Radulescu | |
| 3,747,675 | A | | 7/1973 | Brown | 166/237 |
| 3,796,418 | A | | 3/1974 | Carlberg | |
| 3,808,916 | A | * | 5/1974 | Proter et al. | 81/57.19 |
| 3,838,613 | A | | 10/1974 | Wilms | 81/57.34 |
| 3,933,108 | A | | 1/1976 | Baugh | 114/5 D |
| 3,941,348 | A | | 3/1976 | Mott | 251/58 |
| 3,986,564 | A | | 10/1976 | Bender | |
| 4,005,621 | A | | 2/1977 | Turner, Jr. et al. | 81/57.2 |
| 4,142,739 | A | | 3/1979 | Billingsley | 285/18 |
| 4,159,637 | A | | 7/1979 | Lamb et al. | |
| 4,170,908 | A | | 10/1979 | Peveto et al. | |
| 4,221,269 | A | | 9/1980 | Hudson | |
| 4,246,809 | A | | 1/1981 | Keast et al. | |
| 4,257,442 | A | | 3/1981 | Claycomb | 137/238 |
| 4,262,693 | A | | 4/1981 | Giebeler | 137/494 |
| 4,291,762 | A | | 9/1981 | Gudgel | |
| 4,295,527 | A | | 10/1981 | Russe | |
| 4,315,553 | A | | 2/1982 | Stallings | 175/207 |
| 4,334,444 | A | | 6/1982 | Carstensen et al. | |
| 4,346,629 | A | | 8/1982 | Kinzbach | 81/57.2 |
| 4,401,000 | A | | 8/1983 | Kinzbach | 81/57.2 |
| 4,402,239 | A | | 9/1983 | Mooney | |
| 4,442,892 | A | | 4/1984 | Delesandri | |
| RE31,699 | E | * | 10/1984 | Eckel | 73/862.25 |
| 4,492,134 | A | | 1/1985 | Reinholdt et al. | 81/57.34 |
| 4,499,919 | A | | 2/1985 | Forester | |
| 4,565,003 | A | | 1/1986 | McLeod | |
| 4,573,359 | A | | 3/1986 | Carstensen | |
| 4,593,773 | A | | 6/1986 | Skeie | 175/85 |
| 4,643,259 | A | | 2/1987 | Zeringue, Jr. | 166/77.5 |
| 4,649,777 | A | | 3/1987 | Buck | |
| 4,709,766 | A | | 12/1987 | Boyadjieff | |
| 4,712,284 | A | | 12/1987 | Coyle, Sr. et al. | |
| 4,715,625 | A | | 12/1987 | Shows, Jr. et al. | |
| 4,773,218 | A | | 9/1988 | Wakita et al. | |
| 4,811,635 | A | | 3/1989 | Falgout, Sr. | |
| 4,938,109 | A | | 7/1990 | Torres et al. | |
| 4,979,356 | A | | 12/1990 | Vatne | |
| 5,000,065 | A | | 3/1991 | Haynes | |
| 5,022,472 | A | | 6/1991 | Bailey et al. | 175/195 |
| 5,044,232 | A | | 9/1991 | Schulze-Beckinghausen | |
| 5,092,399 | A | | 3/1992 | Lang | |
| 5,150,642 | A | * | 9/1992 | Moody et al. | 81/57.2 |
| 5,159,860 | A | * | 11/1992 | Pietras | 81/57.19 |
| 5,161,438 | A | | 11/1992 | Pietras | |
| 5,161,548 | A | | 11/1992 | Neville | 131/296 |
| 5,167,173 | A | | 12/1992 | Pietras | 81/57.15 |
| 5,209,302 | A | | 5/1993 | Robichaux et al. | 166/355 |
| 5,221,099 | A | | 6/1993 | Jansch | 279/151 |
| 5,259,275 | A | | 11/1993 | Schulze-Beckinghausen | |
| 5,282,653 | A | | 2/1994 | LaFleur et al. | 285/110 |
| 5,297,833 | A | | 3/1994 | Willis et al. | |
| 5,390,568 | A | | 2/1995 | Pietras | |
| 5,451,084 | A | | 9/1995 | Jansch | 294/1.1 |
| 5,520,072 | A | | 5/1996 | Perry | |
| 5,634,671 | A | | 6/1997 | Watkins | |
| 5,706,893 | A | | 1/1998 | Morgan | |
| 5,730,471 | A | | 3/1998 | Schulze-Beckinghausen et al. | |
| 5,746,276 | A | * | 5/1998 | Stuart | 173/1 |
| 5,787,982 | A | | 8/1998 | Bakke | 166/242.6 |
| 5,819,605 | A | * | 10/1998 | Buck et al. | 81/57.33 |
| 5,839,330 | A | | 11/1998 | Stokka | 81/57.33 |
| 5,842,390 | A | | 12/1998 | Bouligny et al. | |
| 5,845,549 | A | | 12/1998 | Bouligny | |
| 5,890,549 | A | | 4/1999 | Sprehe | 175/71 |
| 5,992,801 | A | | 11/1999 | Torres | |
| 6,065,372 | A | | 5/2000 | Rauch | |
| 6,082,224 | A | | 7/2000 | McDaniels et al. | 81/57.15 |
| 6,082,225 | A | | 7/2000 | Richardson | |
| 6,119,772 | A | | 9/2000 | Pruet | 166/81.1 |
| 6,138,529 | A | | 10/2000 | Pietras | |
| 6,161,617 | A | | 12/2000 | Gjedebo | |
| 6,206,096 | B1 | | 3/2001 | Belik | |
| 6,223,629 | B1 | | 5/2001 | Bangert | |
| 6,305,720 | B1 | | 10/2001 | Spiering et al. | |
| 6,327,938 | B1 | | 12/2001 | Pietras | |
| 6,330,911 | B1 | * | 12/2001 | Allen et al. | 166/77.51 |
| 6,360,633 | B2 | | 3/2002 | Pietras | |
| 6,412,554 | B1 | * | 7/2002 | Allen et al. | 166/80.1 |
| 6,480,811 | B2 | | 11/2002 | Denny et al. | |

FOREIGN PATENT DOCUMENTS

| | | | |
|---|---|---|---|
| EP | 0 311 455 | 12/1989 | E21B/19/16 |
| EP | 0 423 055 | 4/1991 | E21B/17/043 |
| EP | 0 525 247 | 3/1993 | E21B/3/02 |
| GB | 1 215 967 | 12/1970 | B25B/13/50 |
| GB | 2 049 518 | 12/1980 | E21B/19/16 |
| GB | 2 128 526 | 5/1984 | E21B/19/16 |
| GB | 2 300 896 A | 11/1996 | F16K/3/08 |
| GB | 2 346 576 | 8/2000 | E21B/19/16 |
| GB | 2 346 577 | 8/2000 | E21B/19/16 |
| WO | WO 83/03443 | 10/1983 | E21B/19/16 |
| WO | WO 92/18744 | 10/1992 | E21B/19/16 |
| WO | WO 93/18276 | 9/1993 | E21B/19/16 |
| WO | WO 95/20471 | 8/1995 | B35B/17/00 |
| WO | WO 98/16716 | 4/1998 | E21B/21/00 |
| WO | WO 98/32948 | 7/1998 | E21B/19/16 |
| WO | WO 99/34089 | 7/1999 | E21B/19/16 |
| WO | WO 99/34090 | 7/1999 | E21B/21/00 |
| WO | WO 99/34091 | 7/1999 | E21B/21/00 |
| WO | WO 00/22278 | 4/2000 | E21B/19/16 |
| WO | WO 00/23686 | 4/2000 | E21B/19/16 |
| WO | WO 00/45026 | 8/2000 | E21B/19/16 |
| WO | WO 00/45027 | 8/2000 | E21B/19/16 |
| WO | WO 00/79092 | 12/2000 | E21B/21/08 |
| WO | WO 01/03889 A1 | 1/2001 | E25B/17/00 |
| WO | WO 01/09479 | 2/2001 | E21B/19/16 |
| WO | WO 01/38688 | 5/2001 | E21B/19/16 |
| WO | WO 01/66905 A3 | 9/2001 | E21B/19/16 |

* cited by examiner

*Fig. 11*
*(PRIOR ART)*

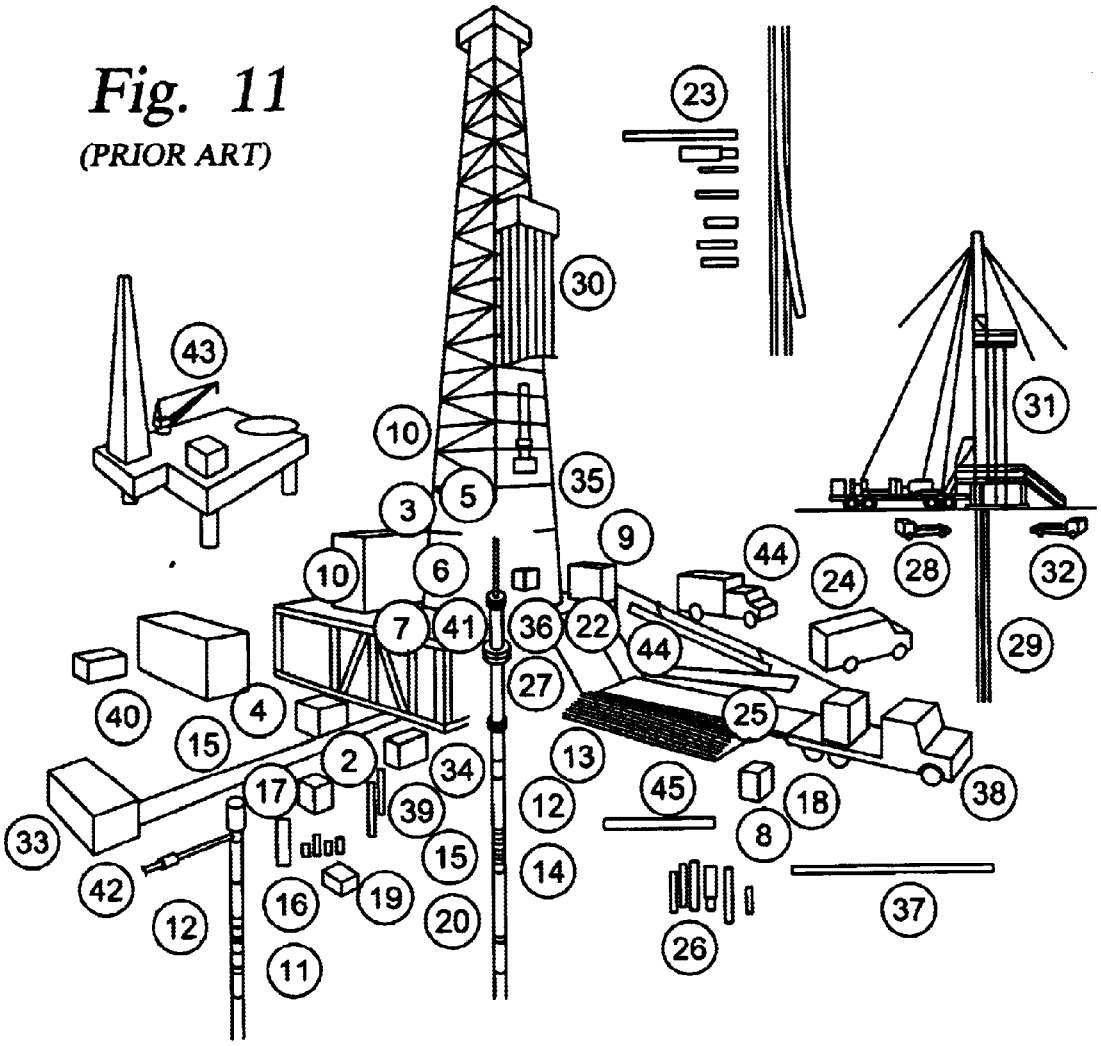

POWER EQUIPMENT TUBALUR SERVICES
1. CASING POWER TOOLS
2. TUBING POWER TONGS WITH HYDRAULIC BACK-UP
3. DRILL PIPE TONGS WITH

HYDRAULIC BACK-UP
4. POWER UNITS
5. KELLY SPINNERS
6. SPINNERHAWK DRILL PIPE SPINNERS
7. SPIDERS & ELEVATORS (RENTAL)
8. FLO-THRU THREAD CLEANNING MACHINES
9. JAM JOINT ANALYZED MAKE-UP SYSTEM

TESTING EQUIPMENT
10. SUPRAHOLD INTERNAL CONNECTION HELIUM GAS-TESTER

CEMENTING EQUIPMENT
11. SPIRALIZER ALUMINUM RIGID CENTRALIZER
12. CENTRALIZER
13. CEMENT BASKET
14. SCRATCHERS
15. STOP COLLARS

FLOAT EQUIPMENT
16 FLOAT SHOES/FLOAT COLLAR
17. STAGE CEMENTING TOOLS

ELASTOMETER PRODUCTS
18. KLEPO THREAD PROTECTORS
19. CEMENTING PLUGS
20. DRILL PIPE/CASING PROTECTORS
21. THREAD PROTECTORS
22. STABBING GUIDE

FISHING & RENTAL TOOLS
23. RETRIEVABEL WHIPSTOCKS AND WHIPSTOCK MILLS
24. FREEPOINT AND BACK-OFF SERVICE (WIRE LINE)
25. SPIRAL-WALE DRILL PIPE
26. FISHING AND MILLING TOOLS
27. BOP'S (RENTAL)
28. MUD PUMPS (RENTAL)
29. CASING PATCH
30. DRILL PIPE (RENTAL)
31. TUBING (RENTAL)
32. POWER SWIVELS (RENTAL)
33. ACCUMULATORS (RENTAL)
34. CHOKE MANIFOLDS (RENTAL)
35. KELLY (RENTAL)
36. KELLY DRIVE BUSHING (RENTAL)
37. SURE SHOT DRIFT INDICATOR

MISCELLANEOUS
38. PICK-UP/LAY DOWN MACHINES
39. BRIDGE PLUGS & CEMENT RETAINERS
40. PRESITION BUCKING UNIT
41. THREAD COMPOUNDS
42. KINZPATCH PRESSURE RELIEF VALVE

OFFSHORE CRANES
43. AMERICAN AERO MARINE CRANES

INSPECTION SERVICES
44.INSPECTION SERVICES

CORING SERVICES
45. CORING SERVICES

Fig. 14A
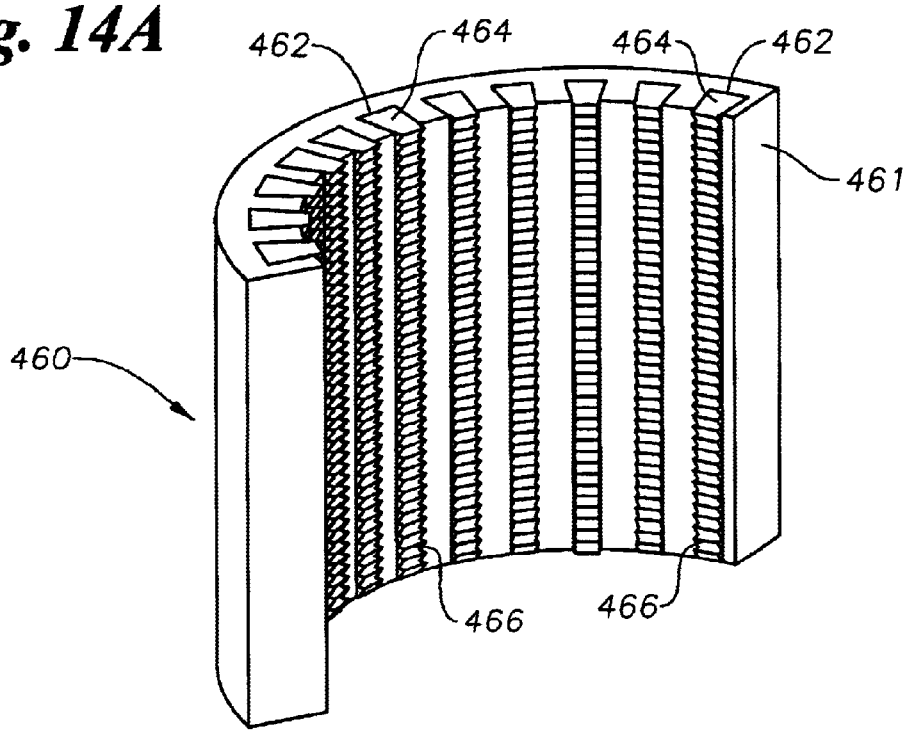
Fig. 14C
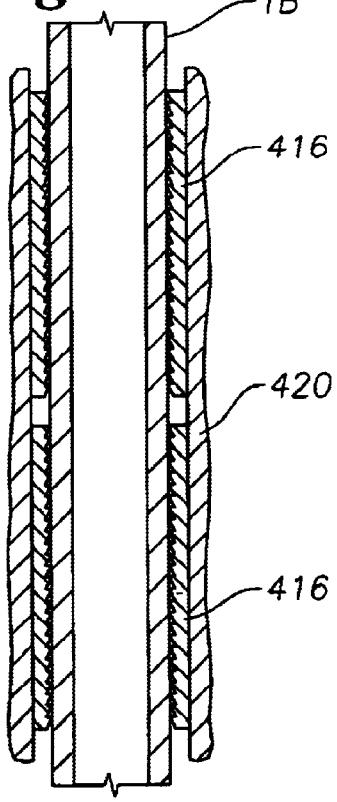
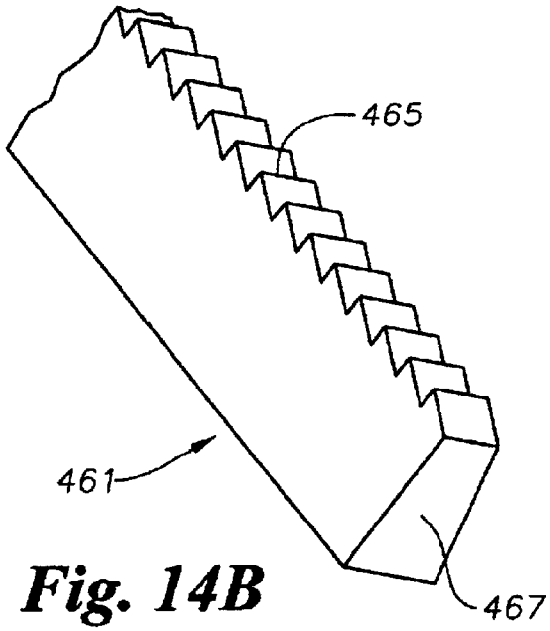
Fig. 14B

TONG FOR WELLBORE OPERATIONS

This is a division of U.S. Ser. No. 09/524,773, filed Mar. 14, 2000, entitled "Wellbore Circulation System," issued as U.S. Pat. No. 6,412,554.

BACKGROUND OF THE INVENTION

1. Field of the Invention

This invention is related to systems and methods for continuously circulating fluid through two tubulars as they are being connected or disconnected; and, in certain particular aspects, to continuously circulating drilling fluid through two drill pipes as they are being connected or disconnected. This invention is further related to an improved tong for connecting or disconnecting tubulars in wellbore operations.

2. Description of the Related Art

In many drilling operations in drilling in the earth to recover hydrocarbons, a drill string of a plurality of threadedly-interconnected pieces of drill pipe with a drill bit at the bottom is rotated to move the drill bit. Typically drilling fluid and/or "mud" is circulated to and through the drill bit to lubricate and cool the bit and to facilitate the removal of cuttings, debris, etc. from the wellbore that is being formed.

As the drill bit penetrates into the earth and the wellbore is lengthened, more joints of tubular drill pipe are added to the drill string. This involves stopping the drilling while the tubulars are added. The process is reversed when the drill string is removed, e.g. to replace the drilling bit or to perform other wellbore operations. Interruption of drilling may mean that the circulation of the mud stops and has to be re-started when drilling resumes. This can be time consuming, can cause deleterious effects on the walls of the well being drilled, and can lead to formation damage and problems in maintaining an open wellbore. Also, a particular mud weight may be chosen to provide a static head relating to the ambient pressure at the top of a drill string when it is open while tubulars are being added or removed. The weighting of the mud can be very expensive.

To convey drilled cuttings away from a drill bit and up and out of a wellbore being drilled, the cuttings are maintained in suspension in the drilling fluid. If the flow of fluid with cuttings suspended in it ceases, the cuttings tend to fall within the fluid. This is inhibited by using relatively thick drilling fluid; but thicker fluids require more power to pump. Further, restarting fluid circulation following a cessation of circulation may result in the overpressuring of a formation in which the wellbore is being formed.

PCT Application PCT/GB97/02815, (John Lawrence Ayling, applicant) discloses a continuous circulation drilling method in which tubulars are added or removed from a drill string while a drill bit is rotated. In one aspect of this system, a connector is used with an inlet and an outlet for the mud, etc. The system incorporates rams to seal off and separate the flow of mud as a tubular is added or removed.

U.S. Pat. No. 3,559,739 to Hutchinson discloses a method and apparatus for maintaining continuous circulation of foam in a well through a segmented tubing string while the tubing string is being made up or broken up. A chamber having a foam entry port is formed around the tubing string above the wellhead. A valve is provided above the foam entry port to close off the upper portion of the chamber when the tubing string is broken and the upper portion thereof raised above such valve. When it is desired to add or remove a tubing section from the tubing string, the tubing string is held by slips with its open end in the lower portion of the chamber. The upper tubing section is lifted in the chamber to above the valve. The valve is closed and foam is circulated in the chamber through the foam entry port to provide for continuous foam circulation while another section of tubing is added or removed from the tubing string.

There has long been a need for an efficient and effective continuous circulation system for tubular connection and disconnections operations. There has long been a need for such a system which can operate with relatively lower viscosity drilling fluids. There has long been a need for such systems that may be used with either a top drive rig or a rotary table/kelly/kelly-bushing rig.

SUMMARY OF THE INVENTION

The present invention, in at least certain preferred embodiments, discloses a continuous circulation system for continuously circulating fluid to a tubular string while a section of tubular is being added or removed. In particular aspects, the tubular string is coiled tubing or a string of drill pipe with a drill bit at its bottom used to drill a wellbore in the earth. Circulation is maintained on such a string during joint makeup and breakout. The present invention further discloses a novel tong that isolates tubulars being handled from high pressure axial loading, thereby preventing the "launch" of a tubular from the system, and, which can be used with a standard top drive rig or with a standard kelly and rotary rig.

In one embodiment positioned between a top chamber and a bottom chamber is a gate apparatus that selectively isolates the two chambers and through which may pass the ends of two tubulars that are joined together, that are to be separated, or that are to be joined together. With suitable valving, pumps, control apparatus and devices, and flow lines, fluid flow is maintained to the tubular string beneath the system through the chambers of the system during both "breakout" and "make up" operations while undesirable leakage of fluid from the system is inhibited or prevented. Seals around each tubular—an upper tubular being added (or removed) from the string and a top tubular of the string situated beneath the upper tubular—prevent fluid from flowing out of the chambers to the environment.

In certain particular aspects the seals in the top chamber and bottom chamber are the stripper rubbers of control heads (rotating or non-rotating). In particular aspects there is an inner bushing or "sabot" that facilitates a tubular's entry into and removal from the chamber. This inner bushing or "sabot" is movably mounted in the system so that it is selectively movable with respect to the stripper rubber to facilitate entry of a tubular end into and through the stripper rubber.

In various particular embodiments the gate apparatus uses one of a variety of structures for sealingly and selectively isolating the top chamber from the bottom chamber; and for providing a selectively operable area through which tubulars may pass during continuous fluid circulation. These gate apparatuses include, in at least certain preferred embodiments, apparatus with a flapper valve, ball valve, plug valve, gate valve or with a blowout preventer (e.g. annular ram-type blind or "CSO" type).

The systems and tong of the present invention are particularly suited for underbalanced drilling operations and for extended reach drilling operations. In certain embodiments of systems and methods according to the present invention, faster connection time is achieved. In certain particular aspects in underbalanced drilling with single-phase or two-phase fluids in the wellbore, the need for check valves (or "string floats") in a drill string is reduced or eliminated; gas pockets do not need to be rented; and continuous fluid circulation can be maintained. There is no need to wait while circulation is shut off to let gas pressure in the wellbore balance with the atmosphere before a connection can be broken.

By controlling the fluid flow rate within chambers of systems according to the present invention, the threads of tubulars within the chambers are not damaged by the fluid under pressure. In certain systems according to the present invention, the chambers are movable both with respect to a system frame and with respect to a rig floor on which the system is mounted. In certain aspects this allows for heave condensation on offshore rigs. In certain aspects an axial alignment apparatus aligns an upper tubular held by the system.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious systems and methods for continuously circulating fluid through a tubular string when a tubular is being connected to or disconnected from the top of the string;

Such systems and methods useful in wellbore drilling operations, including, but not limited to, underbalanced drilling operations and extended reach drilling operations;

Such systems and methods useful with top drive rigs and rotary/kelly rigs;

Such systems and methods with inner bushings or "sabots" for facilitating tubulars' movement with respect to tubular seals or stripper rubbers;

Such systems and methods in which a variety of interchangeable gate apparatuses may be used to provide a sealed central chamber for tubular connection and disconnection;

Such systems and methods that permit operations to be conducted with relatively low viscosity drilling fluid or mud;

Such system and methods that produce wellbores with relatively greater stability due to no or lower pressure shocks to the bore by using relatively low viscosity drilling fluid, by keeping drilling fluid pressure constant and in certain aspects below formation pressure, and without the need to "break" circulation;

Such systems and methods whose use reduces the risk of stuck pipe by continuously maintaining drilled cuttings in circulation;

Such systems and methods that permit constant or almost constant drilling fluid and mud flow from the wellbore being formed to the equipment that processes the fluids;

Such systems that are closed in which the top of the drill pipe string is not open to the atmosphere; and Such systems and methods that permit faster connection time in underbalanced drilling operations with two-phase fluids.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention.

BRIEF DESCRIPTION OF THE DRAWINGS

A more particular description of embodiments of the invention briefly summarized above may be had by reference to the embodiments which are shown in the drawings which form a part of this Specification. These drawings illustrate certain preferred embodiments and are not to be used to improperly limit the scope of the invention which may have other equally effective or legally equivalent embodiments.

FIG. 10A is a view along line 10A—10A of FIG. 10B.

FIG. 11 is a schematic view of a typical prior art rotary rig with which circulation systems disclosed herein according to the present invention may be used.

FIG. 14A is a perspective view of an insert according to the present invention for a tong. FIG. 14B is a side view of a tooth profile for an insert according to the present invention. FIG. 14C is a side view of inserts of a system according to the present invention.

DETAILED DESCRIPTION OF THE PREFERRED EMBODIMENT

Figure 1A:
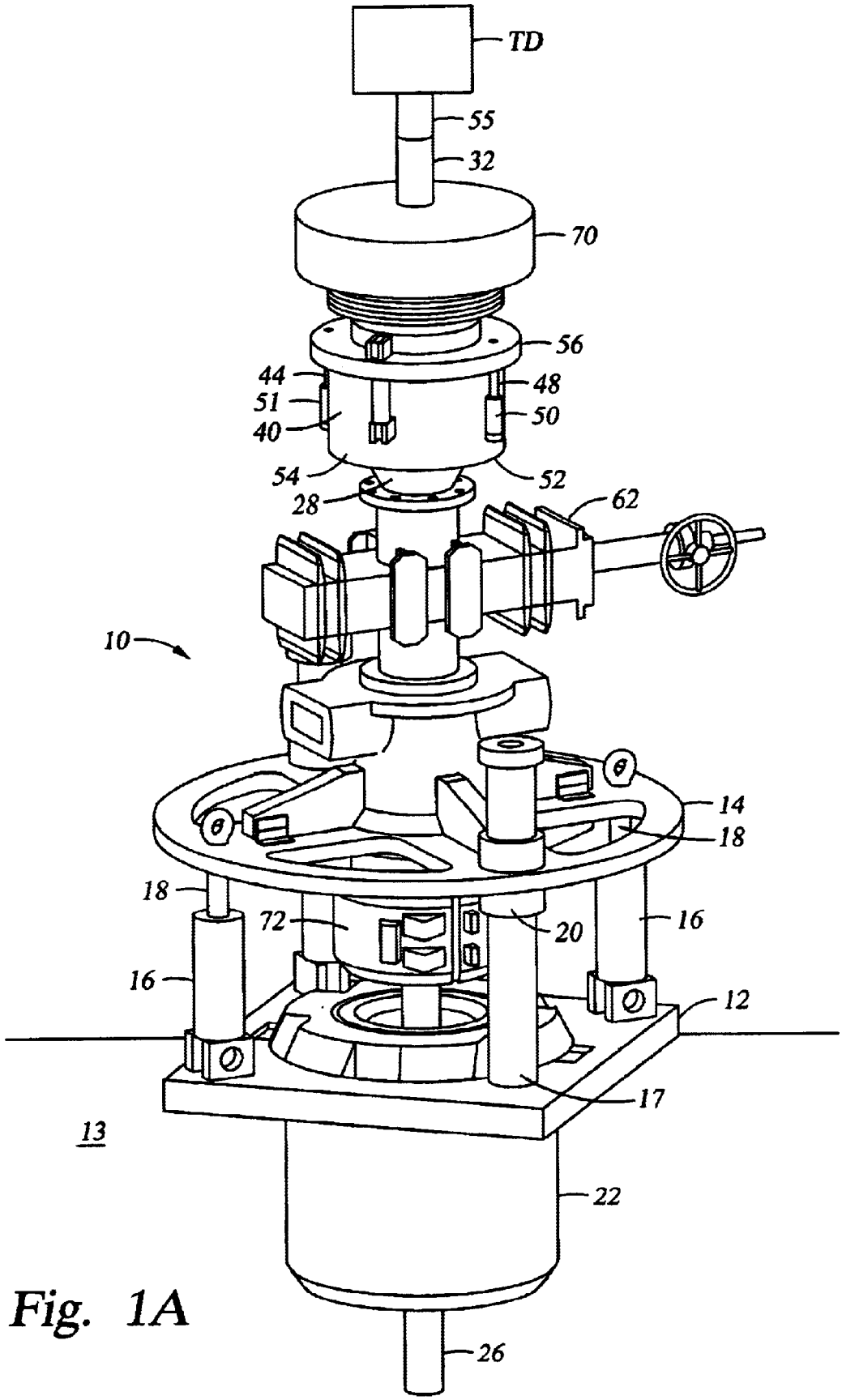
FIG. 1A is a perspective view of system according to the present invention.
Figure 1B:
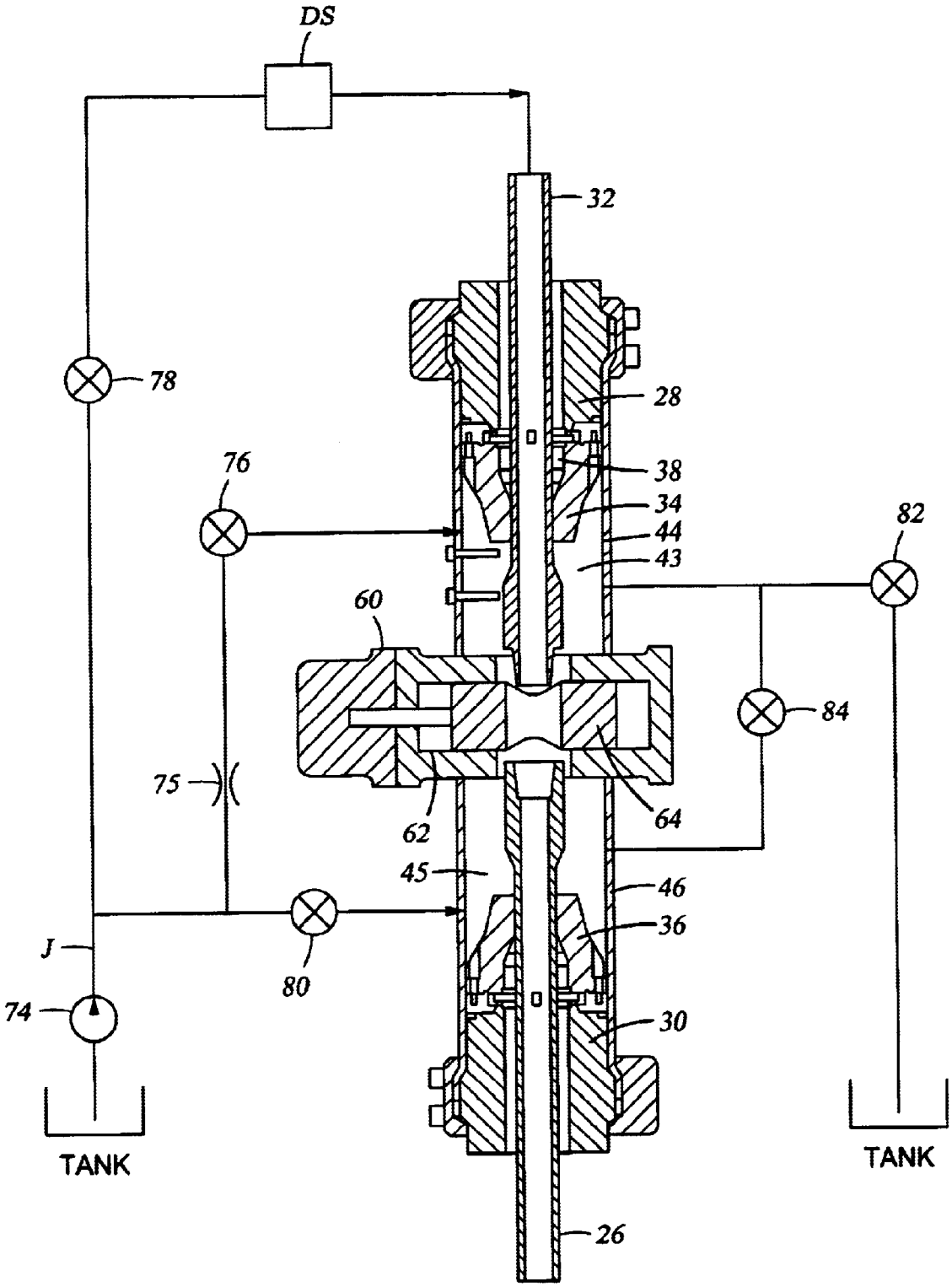
FIG. 1B is a cross-section view of part of the system of FIG. 1A.
Figure 1C:
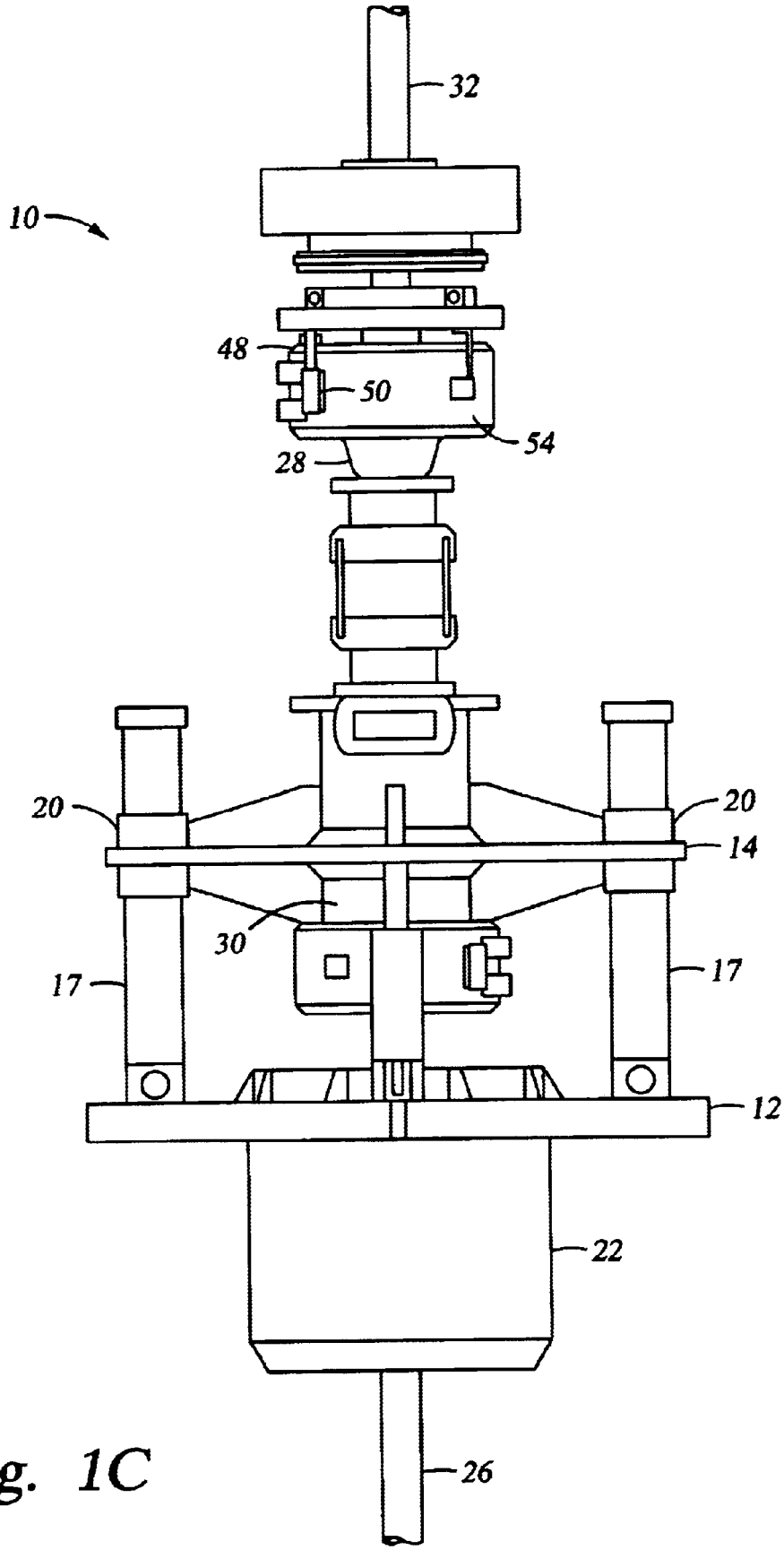
FIGS. 1C and 1D are side views of the system of FIG. 1A.
Figure 1D:
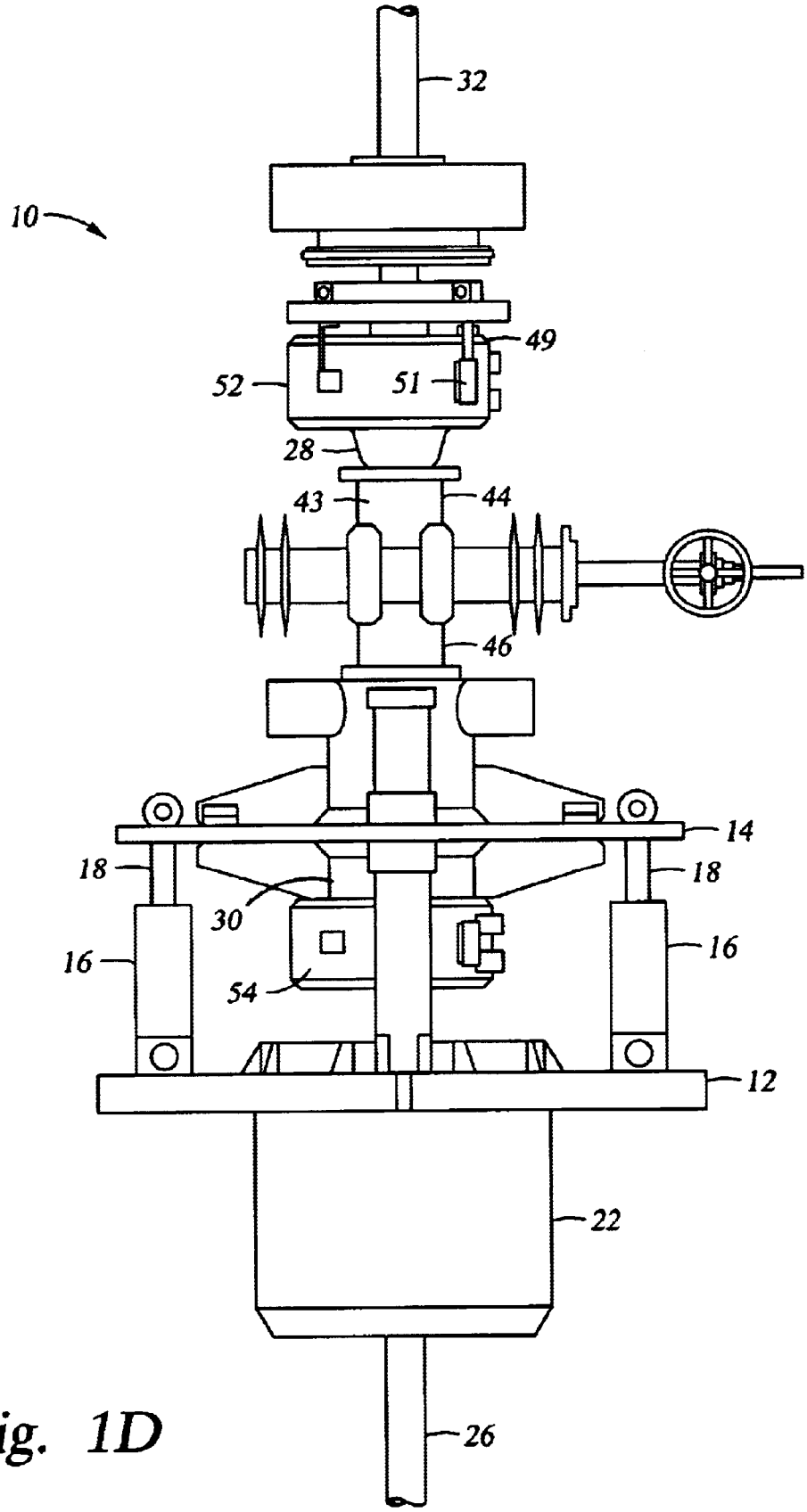
Figure 2:
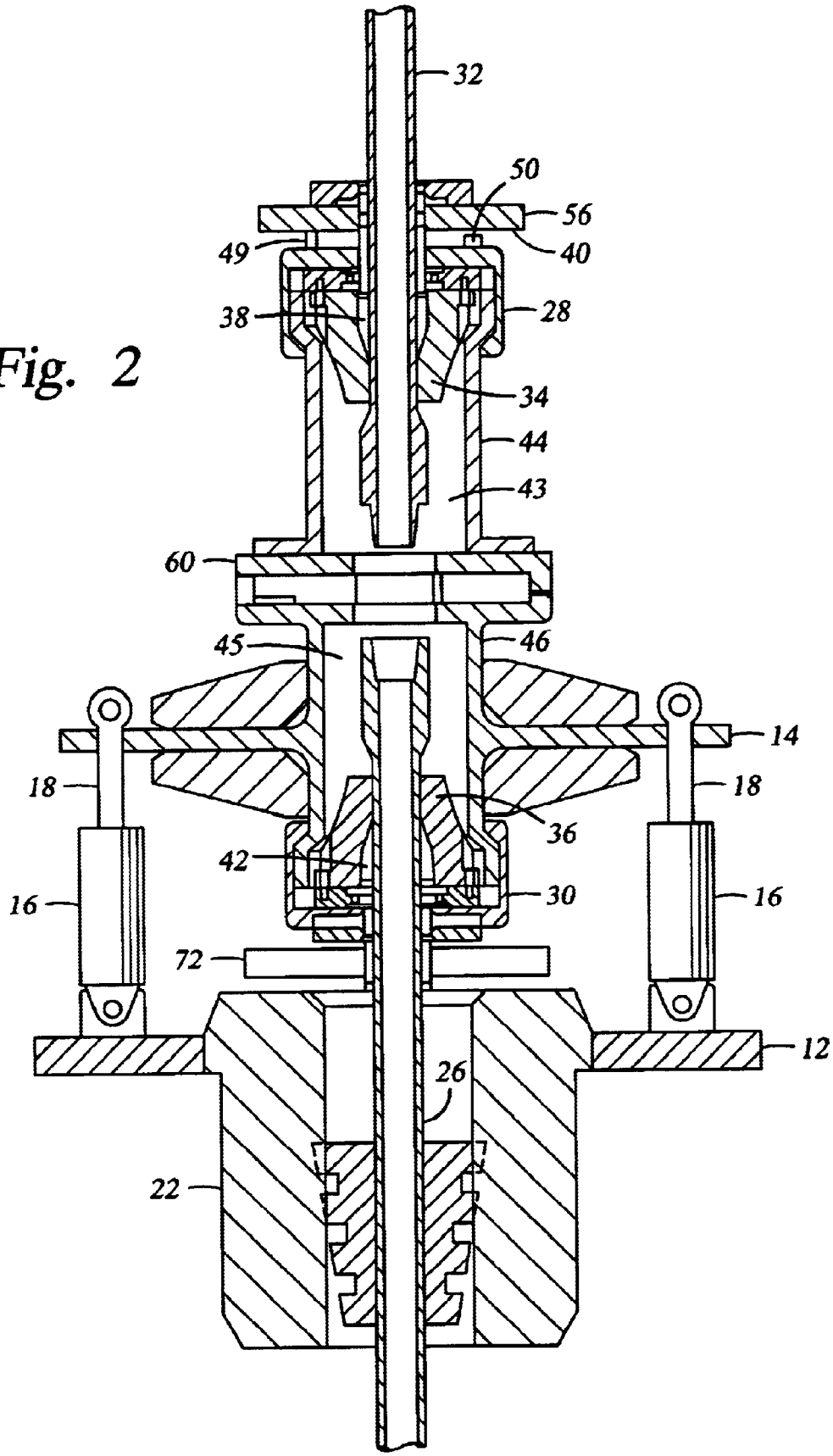
FIG. 2 is a cross-section view of the system of FIG. 1A.

FIGS. 1A–2 show a system 10 according to the present invention with a platform 12 mounted above a rotary table 13 and a platform 14 movably mounted to and above the platform 12. Two cylinders 16 are shown, each having a movable piston 18 to raise and lower the platform 14 to which other components of the system 10 are connected. Any suitable piston/cylinder may be used for each of the cylinders 16/pistons 18 with suitable known control apparatuses, flow lines, consoles, switches, etc. so that the platform 14 is movable by an operator or automatically. Guide posts 17 (one shown in FIG. 1A) secured to the platform 12 move through tubulars 20 of the platform 14 to guide and control movement of the platform 14. Optionally, a top drive TD is used to rotate the drill string. An optional saver sub SS is interconnected between the top drive and the drill string.

A spider 22 including, but not limited to, known flush-mounted spiders, or other apparatus with selectively emplaceable slips extends beneath the platform 12 and accommodates typical movable slips 24 for releasably engaging and holding a tubular 26. Tubular 26 which is the top tubular of a tubular string, e.g. a string of drill pipe, extending down from the rotary table 14 into a wellbore (not shown). The spider 22, in one aspect, may have keyed slips, e.g. slips held with a key that is received and held in recesses in the spider body and slip so that the slips do not move or rotate with respect to the body.

The system 10 has upper control head 28 and lower control head 30. These may be known commercially available rotating control heads. An upper tubular 32 is passable through a stripper rubber 34 of the upper control head 28 to an upper chamber 43. Similarly, the top tubular 26 passes through a stripper rubber 36 of the lower control head 30 to a lower chamber 45. The top tubular 26 is passable through a "sabot" or inner bushing 38. The sabot 38 is releasably held within the upper chamber by an activation device 40. Similarly, the top tubular 26 of the string passes through a sabot or inner bushing 42.

Within housings 44, 46 are, respectively, the upper chamber 43 and the lower chamber 45. The "stripper rubbers" seal around tubulars and wipe them. The sabots or inner bushings 38, 42 protect the stripper rubbers from damage by tubulars passing through them. The sabots also facilitate the tubular's entry into the stripper rubbers.

Movement of the sabots or inner bushing 38 with respect to the stripper rubber 34 is accomplished by the activation device 40 which, in one aspect, involves the expansion or retraction of pistons 48, 49 of cylinders 50, 51. The cylinders 50, 51 are secured to clamp parts 52, 54, (which are releasably clamped together) respectively, of the control heads 28, 30. The pistons 48, 49 are secured, respectively, to a ring 56 to which the sabots themselves are secured. The cylinders 50, 51 may be any known suitable cylinder/piston assembly with suitable known control apparatuses, flow lines, switches, consoles, etc. so that the sabots are selectively movable by an operator (or automatically) as desired, e.g. to expand the stripper rubbers and protect them during tubular joint passage therethrough, then to remove the sabots to permit the stripper rubbers to seal against the tubulars.

Disposed between the housings 44, 46 is a gate apparatus 60 which includes movable apparatus therein to sealingly isolate the upper chamber 43 from the lower chamber 45. Joint connection and disconnection may be accomplished in the lower chamber or in the upper chamber.

In a particular embodiment of the system 10, the gate apparatus 60 is a gate valve 62 with a movable gate 64 and an inner space that defines a central chamber 66 within which the connection and disconnection of tubulars can be accomplished.

In certain embodiments, the tong 70 is isolated from axial loads imposed on it by the pressure of fluid in the chamber (s). In one aspect lines, e.g. ropes or cables, or fluid operated (pneumatic or hydraulic cylinders) connect the tong to platform 14 to another aspect of a gripping device such as, but not limited to a typical rotatably mounted snubbing spider, grips the tubular below the tong and above the control head or above the tong, the snubbing spider connected to the platform 14 to take the axial load and prevent the tong 70 from being subjected to it. Alternatively the tong itself may have a jaw mechanism that can handle axial loads imposed on the tong. A power tong 70 (shown schematically in FIG. 1A) with a typical back-up apparatus 72, e.g. but not limited to, a suitable known back-up tong or gripper may be used with the system 10 (and with any system according to the present invention disclosed herein). In one preferred aspect the tong uses bi-directional inserts or dies.

FIG. 1B illustrates one fluid power/control circuit for a system according to the present invention like the system 10. Fluid is pumped from a fluid supply reservoir ("TANK") by a pump 74 through a line J and is selectively supplied to the lower chamber 45 with valves 76, 78, 82, 84 closed and a valve 80 open. Fluid is selectively supplied to the upper chamber 43 with the valves 78, 80, 82, 84 closed and the valve 76 open. Fluid in both chambers 43, 45 is allowed to equalize by opening valve 84 with valves 78, 82 closed. By providing fluid to at least one of the chambers 43, 45 when the chambers are isolated from each other or to both chambers when the gate apparatus is open, continuous circulation of fluid is maintained to the tubular string through the top tubular 26. This is possible with the gate apparatus opened (when the tubulars'ends are separated or joined); with the gate apparatus closed (with flow through the lower chamber 45 into the top tubular 26); or from the upper chamber 43 into the lower chamber when the gate apparatus is closed. A choke 75 (or other suitable flow controller) controls the rate of fluid pressure increase so that fluid at desired pressure is reached in one or both chambers and damage to the system and items therein is inhibited or prevented.

Figure 3:
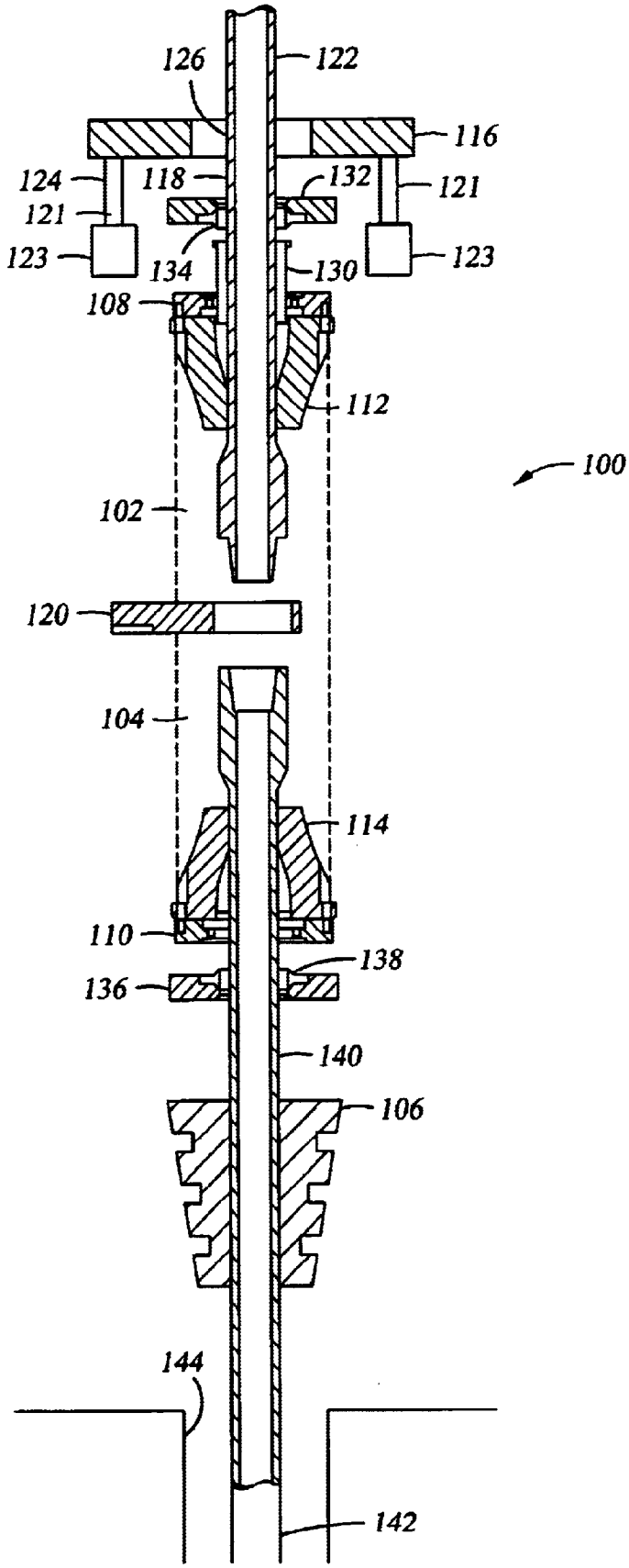
FIG. 3 is a cross-section view of a system according to the present invention.

FIG. 3 shows a system 100 according to the present invention with an upper chamber 102 (defined, e.g. by a housing as is the upper chamber 43 in the system 10, FIG. 1A) and a lower chamber 104 (defined, e.g. by a housing as is the lower chamber 45 in the system 10, FIG. 1A). Slips 106 are like the slips 24 of the system 10 and the system 100 is usable on a rotary rig like that with the rotary table 14 of the system 10. Upper and lower control heads 108, 110 have, respectively, stripper rubbers 112, 114. In certain preferred embodiments the control heads are rotating control heads as are well known and commercially available.

A gate apparatus 120 separates the chambers 102, 104 and is selectively openable so that the chambers are in fluid communication. Any gate apparatus disclosed herein may be used for the gate apparatus 120. A tong 116 is shown schematically gripping a lower end 118 of an upper tubular 122; but it is within the scope of this invention for any embodiment for a tong to be positioned anywhere in or on the system where it can conveniently and effectively grip a tubular.

An axial alignment mechanism 124 with a tong 116 that grips the tubular has an inner throat or channel 126 for receiving the upper tubular 122. Pistons 121 of cylinders 123 are movable up and down to move the tong 116 to axially align a tubular. Known control apparatuses, flow liens, switches, consoles, etc. (wired or wireless; operator controlled and/or automatic) may be used to effect correct axial positioning of the tubulars.

A "sabot" or inner bushing 130 encircles the upper tubular 122 and facilitates movement of the upper tubular 122 with respect to a stripper rubber 112 of a control head. A top guide 132 with a wiper 134 encompasses the upper tubular 122, guides the upper tubular through the stripper rubber 112 and protects the stripper rubber from damage by the tubular its travel with respect to the tong and the system's chambers. A bottom guide 136 with a wiper 138 encompasses a top tubular 140 of a tubular string 142 extending into a wellbore 144; protects the system's chambers from damage; guides the upper tubular through the lower stripper rubber, reducing wear on it; retains the lower stripper rubber in place; and guides the tubular 140 in its travel with respect to system's chambers.

Figure 4A:
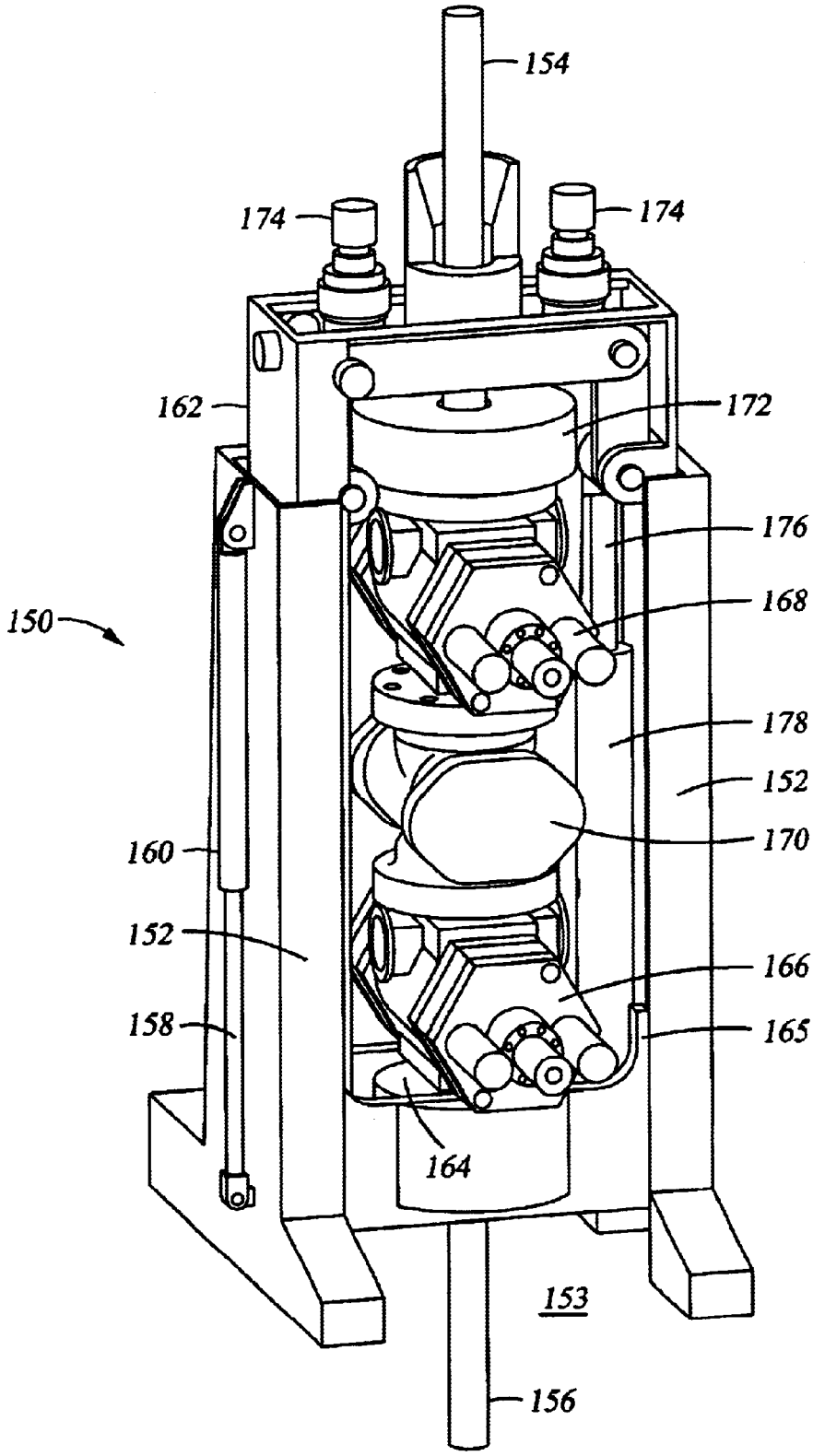
FIG. 4A is a perspective view of a system according to the present invention.
Figure 4B:
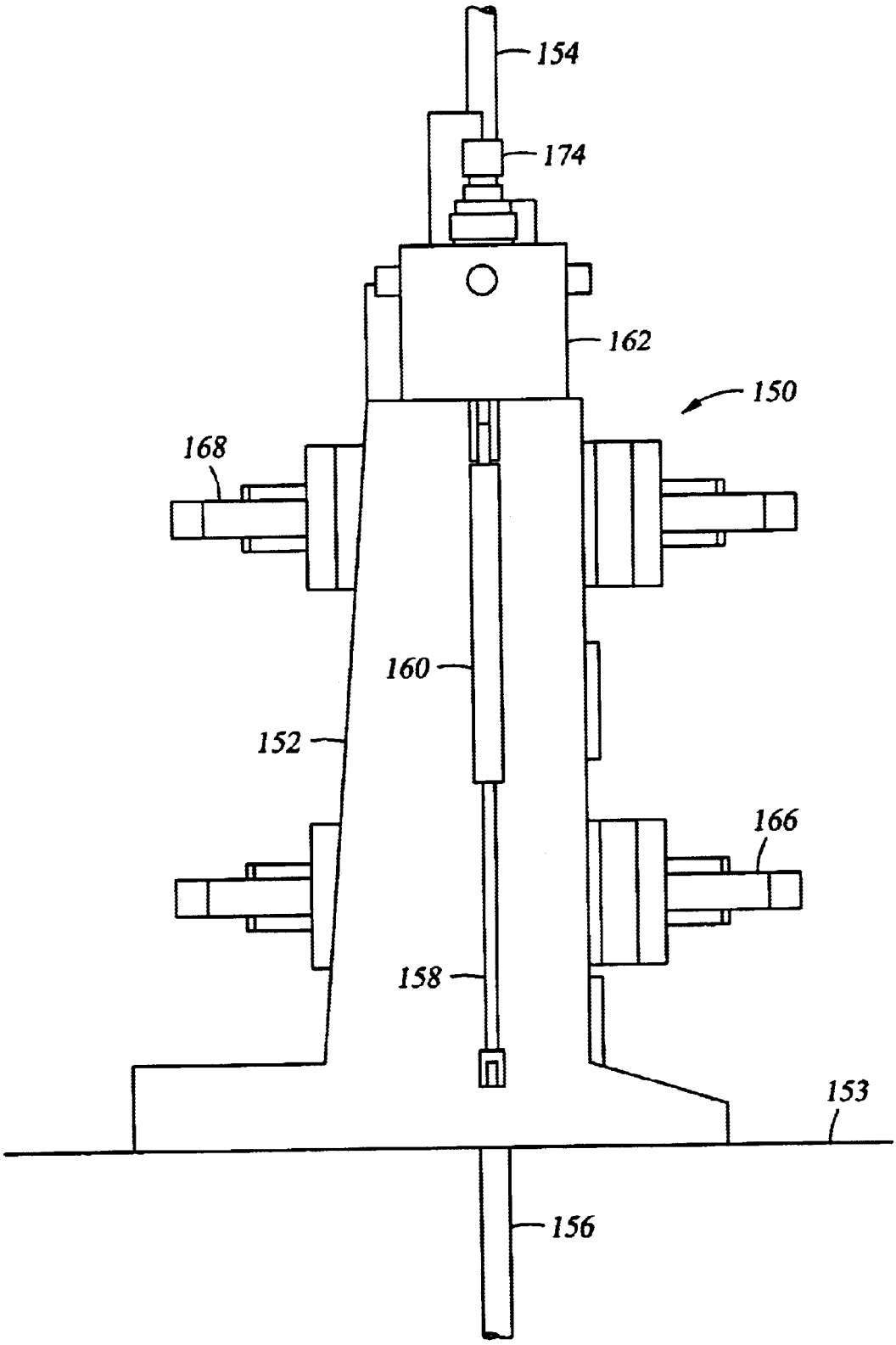
FIG. 4B is a side view and FIG. 4C is a front view of the system of FIG. 4A.

FIGS. 4A–4B show a system 150 according to the present invention with support pedestals 152 on a rig floor 153 of a rig (not shown; e.g. a typical rotary table rig). The system 150 is used to either connect or disconnect an upper tubular 154 and a top tubular 156 of a string of tubulars (not shown) extending beneath the rig into a wellbore.

Components of the system 150 supported by the pedestals 152 are movable with respect to the pedestals 152 by extending or retracting pistons 158 of cylinders 160 (one shown) one on the side of each of the pedestals. At one end (bottom end) the pistons 158 are secured to the pedestals and at the other end (top end) the cylinders 160 are secured to a frame 162 that holds components of the system 150 between the pedestals 152. Frame connections 165 move in slots (not shown) at the pedestals.

The system 150 includes a lower gripper or back-up tong 164 above which is mounted a typical blowout preventer 166. Above the blowout preventer 166 is a gate apparatus 170 which may be any gate apparatus disclosed herein. A blowout preventer 168 is mounted above the gate apparatus 170.

A tong 172 is mounted above the blowout preventer 168 for gripping and rotating the tubular 154. In one aspect, the tong 172 is a power tong powered by tong motors 174. This system 150 may include control heads and one or more movable sabots or inner bushings as in the system 10 above.

The tong 172 is movable with respect to the back-up tong 164 and, hence, movable with respect to the blowout preventer 168 and items below it by expanding or contracting pistons 176 of cylinders 178. The lower end of the cylinders 168 are secured to the frame 165.

When used in a top drive drilling system, in a system according to the present invention whatever is gripping the tubulars of the string rotates when the top drive shaft rotates.

Figure 5:
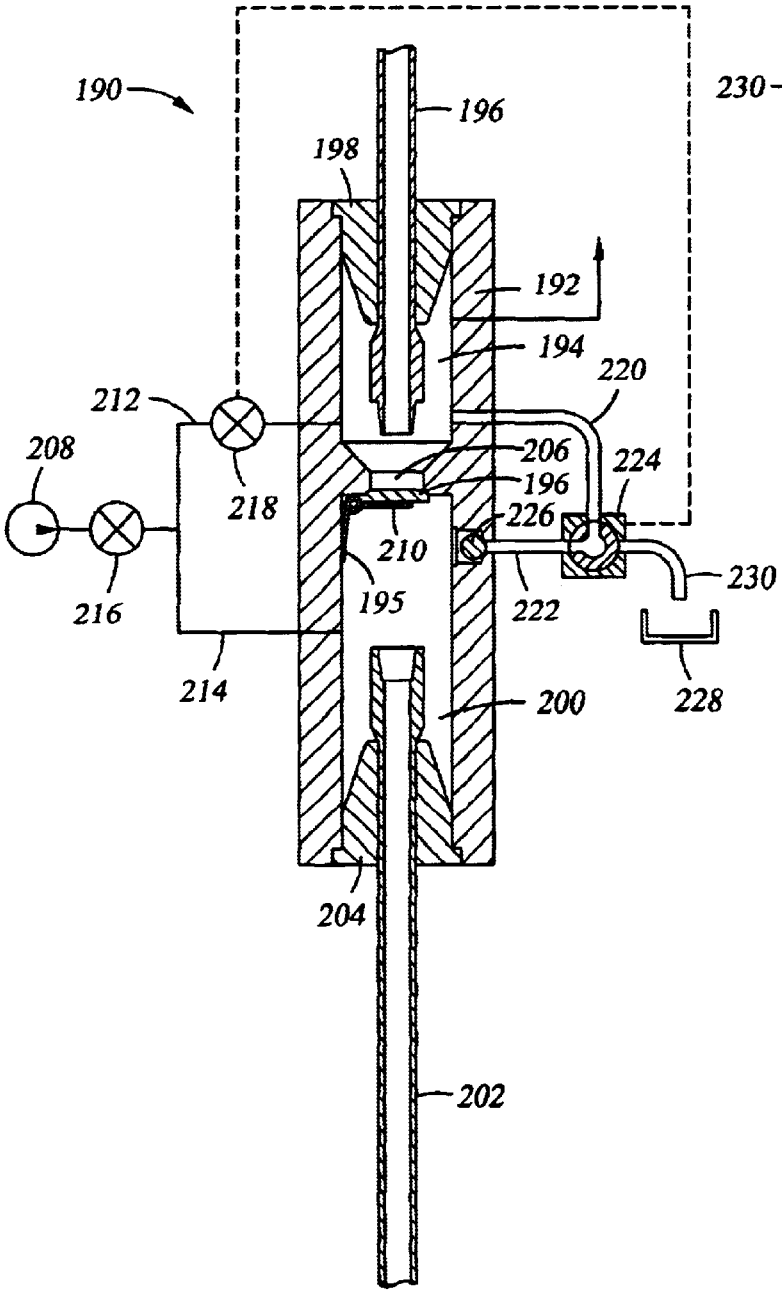
FIG. 5 is a perspective view of a system according to the present invention.
Figure 6:
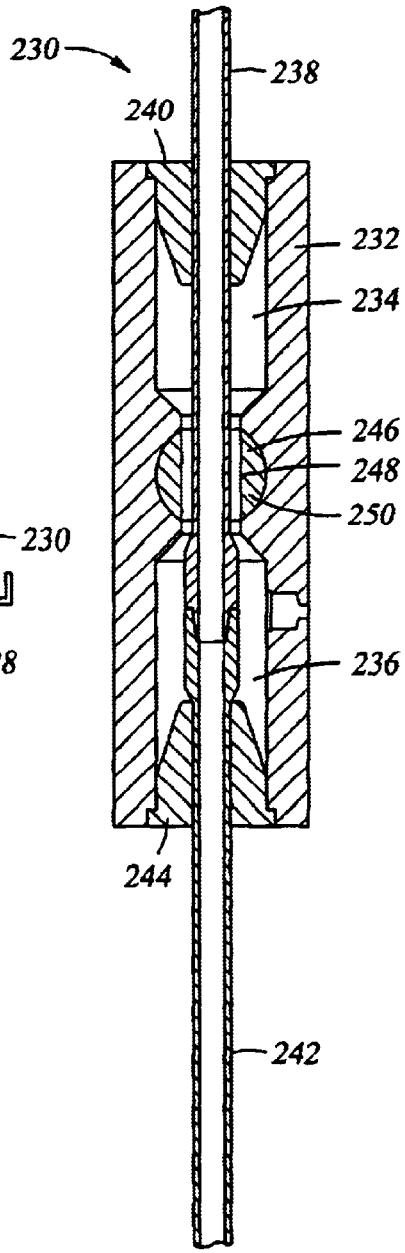
FIG. 6 is a perspective view of a system according to the present invention.

FIGS. 5 and 6 illustrate alternative embodiments for upper and lower chambers and gate apparatuses for systems according to the present invention. FIG. 5 shows a system 190 according to the present invention with a housing 192 having an upper chamber 194 in which is removably positioned a lower end of an upper tubular 196 that extends through an upper stripper rubber 198; and a lower chamber 200 in which is removably positioned a top end of a top tubular 202 (e.g. a top tubular of a string, e.g. a drill string of drill pipe) that extends through a lower stripper rubber 204. A channel 206 between the upper chamber 194 and the lower chamber 200 is selectively openable and closable with a flapper valve 210.

Drilling fluid is selectively pumped to the chambers 194, 200 from a mud system 208 (any suitable known drilling fluid/mud processing system—also usable with any system disclosed herein) via lines 212, 214 controlled by valves 216, 218. Fluid is evacuated from the chambers to a reservoir 228 via lines 220, 222 and 230 in which flow is controlled by a valve 224. A check valve 226, in one aspect a ball-type check valve 226 prevents backflow when circulating from the bottom chamber only. The valve 210 automatically opens or closes by the action of a tubular end, e.g. by contact with the pin end of the upper tubular. To open the valve 210 pressure between the upper and lower chambers is equalized and then the pin end of the upper tubular is pulled down by moving a tong downwardly with its associated movement cylinders (not shown, like those of the system 10 or of the system 150). The valve 210 closes automatically when a tubular's end is raised up through the channel 206. Such automatic closing can be effected with a spring 195, counter weight, or other apparatus or structure for supplying a closing force to the valve. The valve 224 may be set to allow fluid flow only from the upper chamber, only from the lower chamber, or to equalize fluid pressure in the two chambers.

A system 230 according to the present invention as shown in FIG. 6 has a housing 232 that defines an upper chamber 234 and a lower chamber 236. An upper tubular 238 has a lower end extending (removably) down into the lower chamber 236. A top tubular 242 of a tubular string (e.g. any string disclosed herein) extends (removably) up into the lower chamber 236. The upper tubular 238 extends through a stripper rubber 240 and the top tubular 242 extends through a stripper rubber 244. The lower chamber 236 is sized and configured for connection and disconnection therein of the tubulars.

A gate apparatus 250, in this case a ball or plug valve 246, controls fluid flow between the two chambers via a channel 248.

Any control heads, alignment mechanisms, top and bottom guides, tongs, back-ups raising and lower devices, and/or guides and wipers disclosed herein may be used with the systems of FIGS. 3, 4, 5, and 6.

Figure 7:
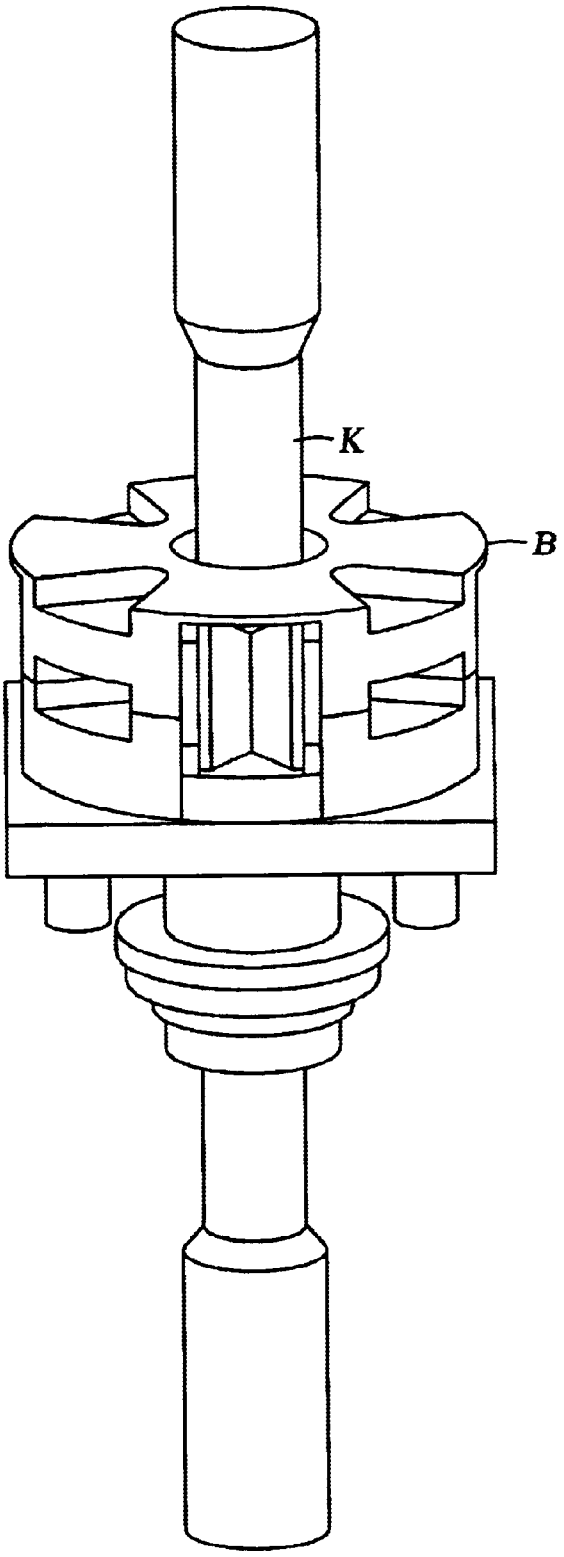
Fig. 7 (PRIOR ART)
FIG. 7 is a perspective view of a prior art kelly and kelly bushing.

FIG. 7 shows a prior art kelly K and a prior art kelly bushing B as are typically used with prior art rotary/kelly rigs.

Figure 8A:
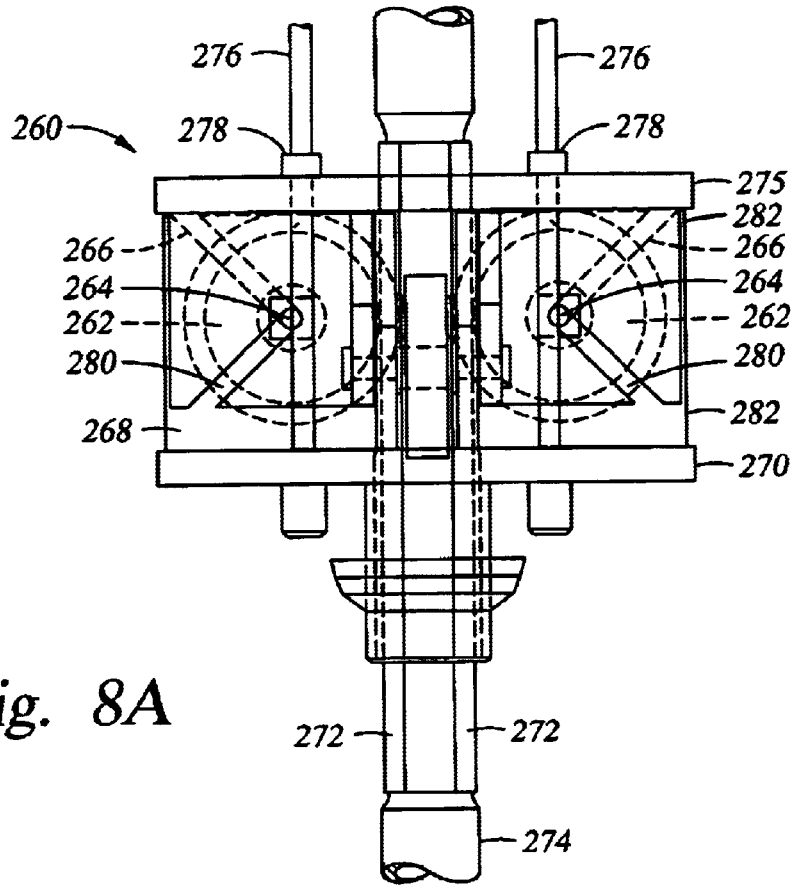
FIG. 8A is a side view of a kelly bushing according to the present invention.
Figure 8B:
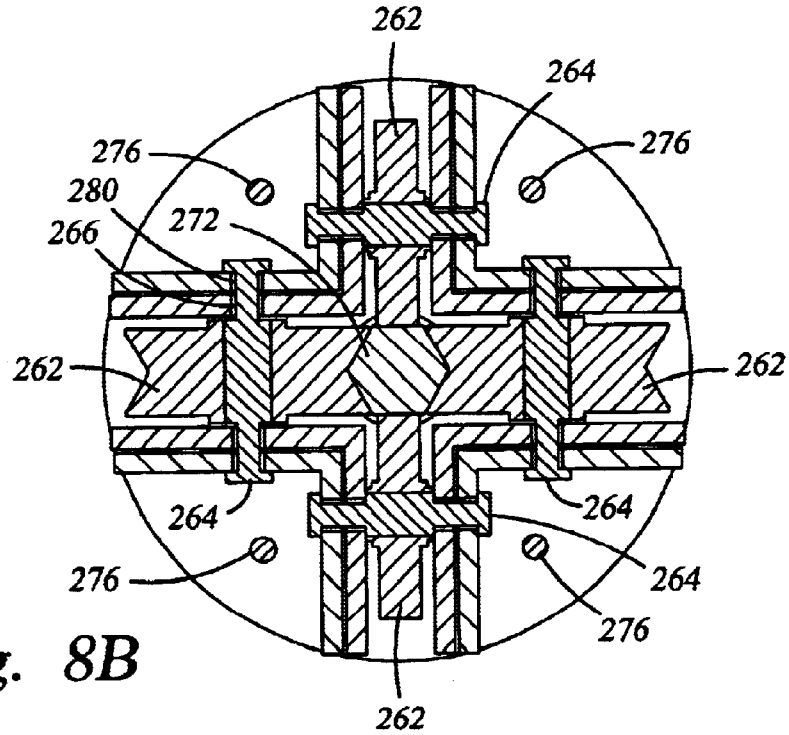
FIG. 8B is a cross-section view along line 8B—8B of FIG. 8A.

FIGS. 8A and 8B show a kelly bushing 260 according to the present invention with a plurality of spaced-apart rollers 262 each rotatably mounted on an axle 264 which is movable up/down, in and out in a slot 266 of a support 268 on a base 270. The rollers 262 are positioned so their outer diameters contact flat surfaces 272 of a kelly 274. The position of the rollers 262 is adjustable by moving a leveling bar 275 up and down which raises and lowers the axles 264 in the slots 266 and slots 280. Moving the leveling bar 275 in effect moves the intersections of the slots 266 and 280 toward and away from the apparatus center line.

Figure 8C:
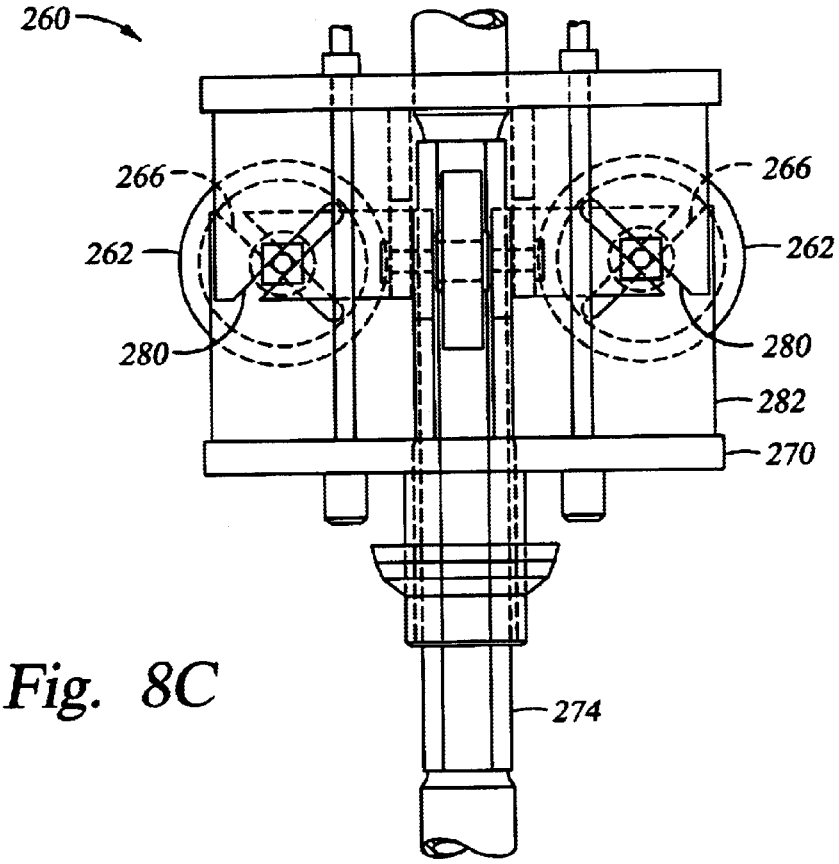
FIG. 8C is a side view of the kelly bushing of FIG. 8A.
Figure 8D:
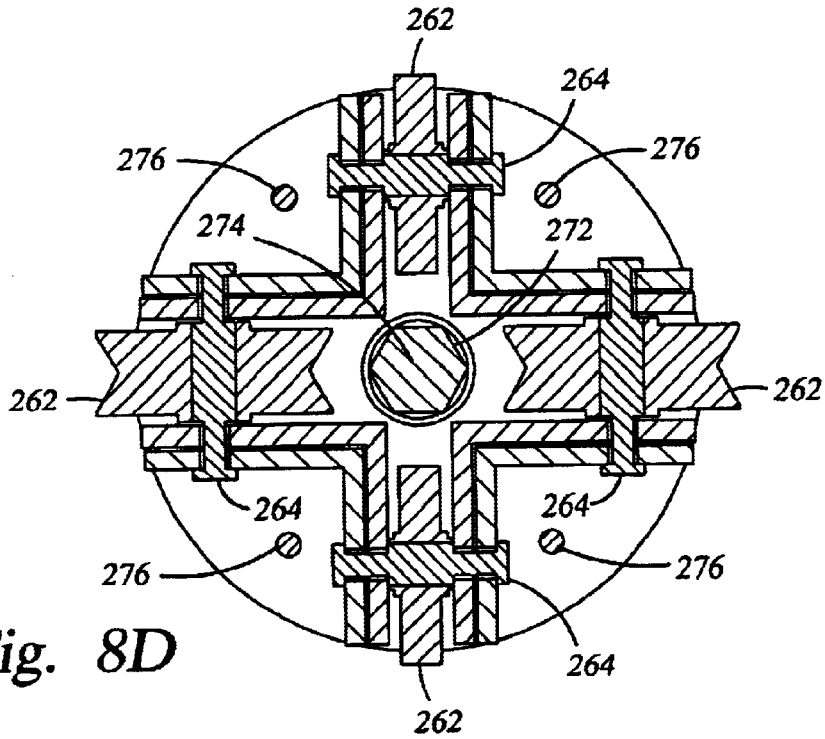
FIG. 8D is a cross-section view along line 8D—8D of FIG. 8C of the kelly bushing as shown in FIG. 8C.

Guide rods 276 guide the movement of the leveling bar 275 with respect to the base 270 and resist bending forces imposed on guide bushings 278. The guide bushings 278 maintain the leveling bar 275 perpendicular to the guide rods and, therefore, level with respect to the base 270 so, preferably, the rollers are maintained equidistant from the center lien of the device. Raising and lowering the leveling bar 275 moves the roller axles 264 and hence the rollers 262 out (FIGS. 8C, 8D) or in (FIGS. 8A, 8B) respectively. When the rollers move out, they allow the tool joint of the kelly to pass. When the rollers move in, they press against the flats of the kelly. This allows torque to be transmitted from the kelly bushing base to the kelly. Each of the axles 264 moves in two slots, a slot 280 in the support 282 and in a base slot 266 in the support 268. The action of the axles 264, slots 266 and 280, leveling bar 275, guide bushings 278, and guide rods 270 maintains the rollers 262 level and equidistant from the kelly.

Figure 9A:
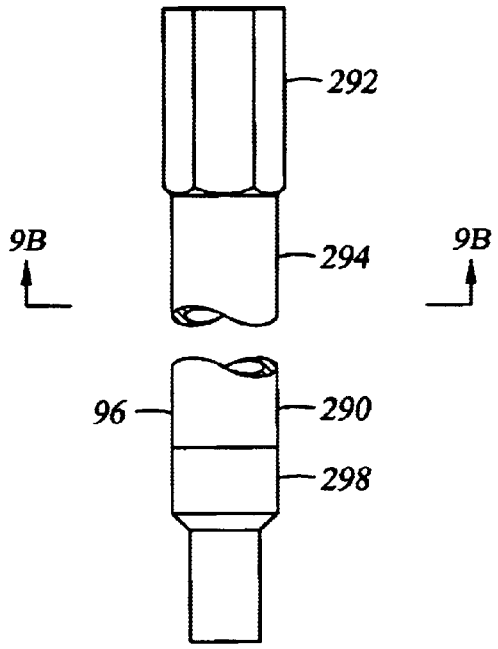
FIG. 9A is a side view of a kelly according to the present invention.
Figure 9B:
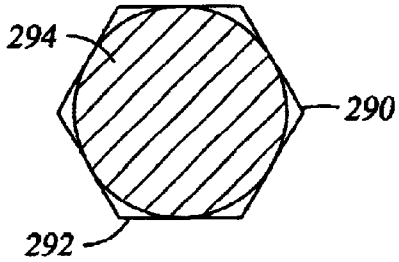
FIG. 9B is a cross-section view along line 9B—9B of FIG. 9A.

FIGS. 9A and 9*b* show a kelly 290 according to the present invention with a hex-shaped portion 292 and round portion 294. A lower end 296 of the kelly 290 is threadedly connected to an upper end of a tubular 298, e.g. a tool joint or drill pipe. The flats of the kelly 290 have a spread that is equal to or greater than the diameter of the kelly tool joint of drill pipe tool joint. This allows the drill pipe or kelly to pass through the kelly bushing. Thus the kelly bushing remains in place when the rig lifts the kelly or drill string.

Figure 9C:
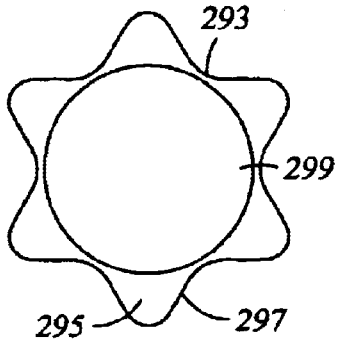
FIGS. 9C and 9D are cross-section views of kellys according to the present invention.
Figure 9D:
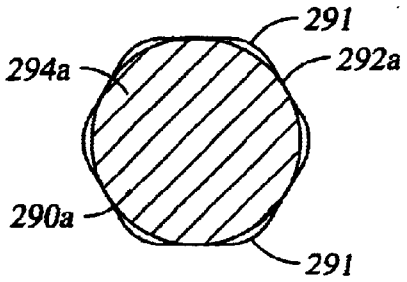

In certain aspects the kelly 290 has a diameter across the flat surfaces (i.e., from one flat surface across the cross-section of the kelly to the other) is as large or larger than the largest diameter of the tool joint 298 and others connected to it, allowing the tool joints (and pipes in a drill string) to pass through a kelly bushing according to the present invention unimpeded without the need to remove the kelly bushing. FIG. 9D shows an alternative form 290*a* of the kelly 290 of FIG. 9A which has a round portion 294*a* corresponding to the round portion 294, FIG. 9A. Edges 291 of the flat sections 292*a* of the kelly 290*a* are rounded off, but the flat surfaces are still of sufficient size when the diameter from one flat surface to the other is as stated above, for effective rotation of the kelly. FIG. 9C illustrates an alternative form for a kelly 293 which has a round portion 299 (like the round portion 294, FIG. 9A) and a plurality of lobed surfaces 297 in a kelly portion 295. In certain preferred embodiments of systems according to the present invention, the kelly is sufficiently long that part of the extension or tool joint portion of the kelly is present in the desired chamber of the system while a portion of the tool joint (rather than a hex or flats portion) is also presented to the tong. In certain preferred embodiments the body (e.g. the body 294 or the body 294*a*) is sufficiently long that a part of the tool joint below the body (e.g. tool joint 298) is within the upper chamber and part is adjacent the tong for gripping and rotating, i.e. so the tong does not grip or attempt to grip the "hex" part of the kelly and so no seal against the "hex" part is attempted. In one particular aspect the body of the new kelly is between 5 and 10 feet long; and in one aspect, about 6 feet long.

Figure 10A:
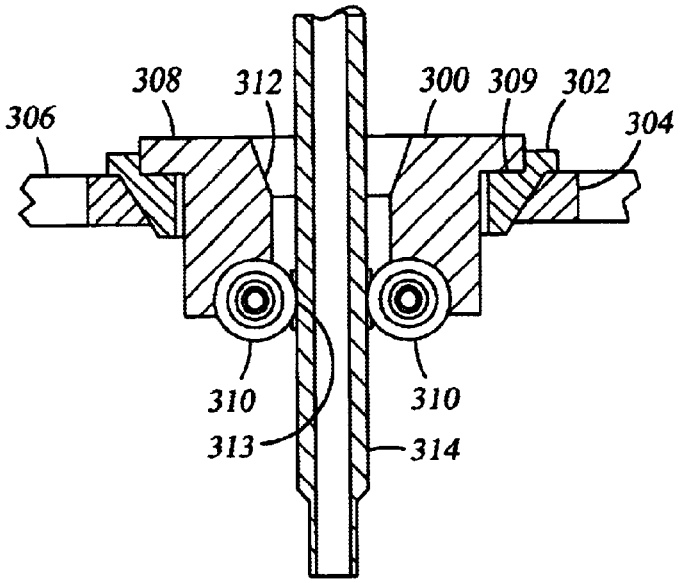
FIG. 10A is a side view of a kelly bushing according to the present invention.
Figure 10B:
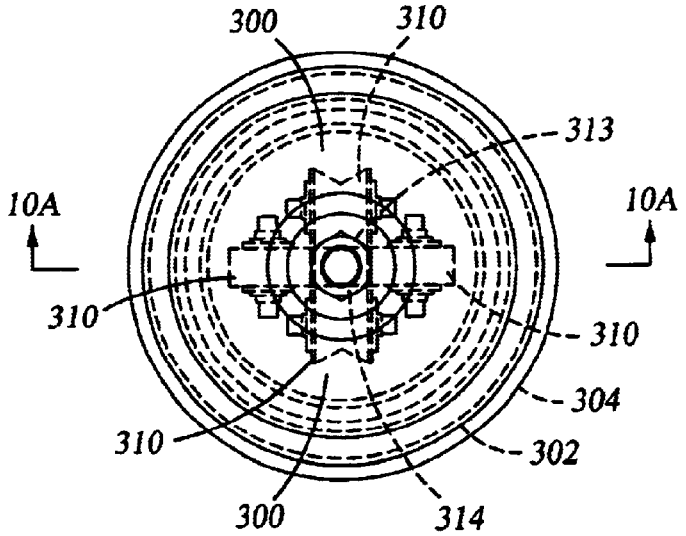
FIG. 10B is a cross-section view along line 10B—10B of FIG. 10A.

FIGS. 10A and 10B show a new kelly bushing 300 with a new slip bowl 312 according to the present invention for use in a typical adapter bushing 302 in a rotary 304 of a rotary rig (not shown) having a rig floor 306.

Figure 10C:
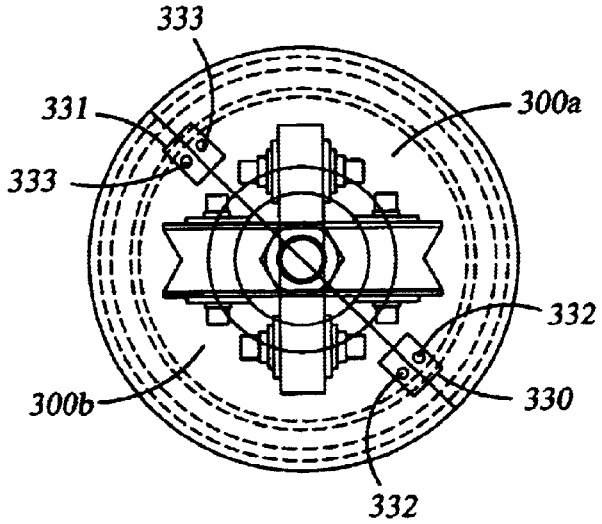
FIG. 10C is a top view of a body for the kelly of FIG. 10A.

A lip 308 of the slip bowl 312 rests on a corresponding recess 309 of the bushing 302. A plurality of rollers 310 are rotatably mounted to a slip bowl 312 extending down into the rotary table and beneath the rig floor. Each roller 310 contacts one or more flat surfaces 313 of a kelly 314. FIG. 10C shows another embodiment for the body 300 in which two halves 300*a* and 300*b* are selectively releasably secured together, e.g. by plates 330, 331 and their corresponding bolts 332, 333 extending through the plates and into one of the body halves; or by bolts (not shown) bolting the two halves together.

Using the new kelly bushing according to the present invention provides a new rotary table or rig floor with a kelly bushing below (or with a major portion below) the table or floor upper level with kelly rollers beneath the table (or floor) rather than on it. Using such a new kelly bushing also permits the use of hand slips within the slip bowl 312 associated with the new kelly bushing. The adapter bushing 302 is optional. A new kelly bushing according to the present invention of appropriate size and configuration may be provided that is emplaced in the rotary table without an adapter bushing (like the bushing, 302).

With a circulation system according to the present invention, a longer saver sub may be used below the top drive on a top drive rig or below the hex part of a kelly on a rotary rig.

FIG. 11 shows a typical prior art rotary rig and derrick with which a continuous circulation system according to the present invention may be used. A kelly and/or kelly bushing according to the present invention may also be used with the rig of FIG. 11 instead of the prior art kelly and/or kelly bushing shown in FIG. 11. Systems according to the present invention may be used with any known prior art rotary rig.

Figure 12A:
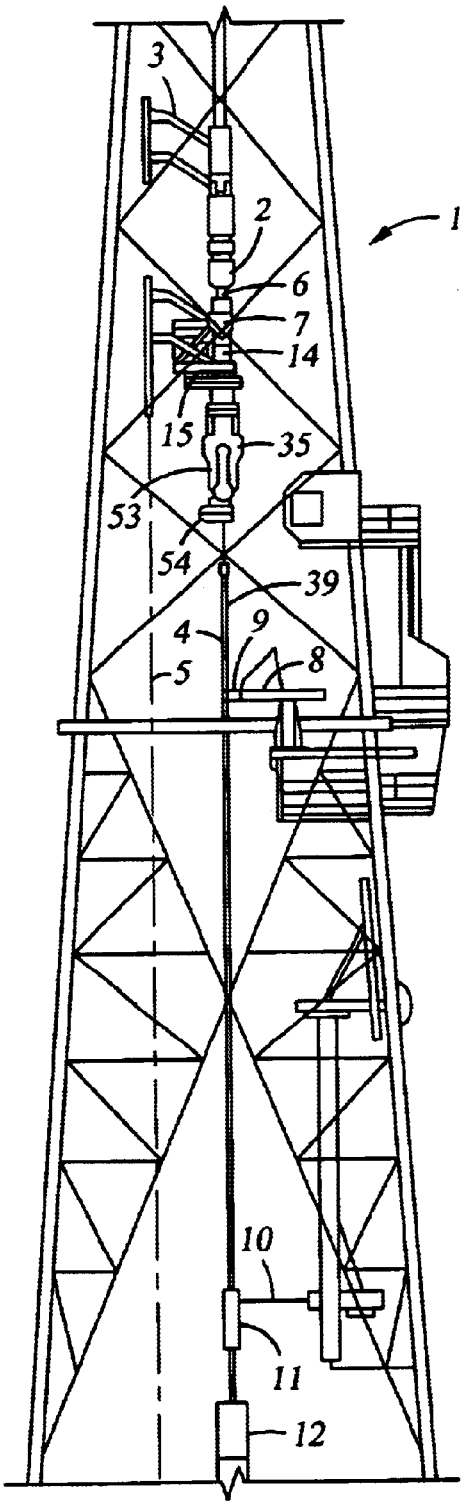
Fig. 12A (PRIOR ART)
FIG. 12A is a side view of a prior art derrick and top drive with which circulation systems according to the present invention may be used.
Figure 12B:
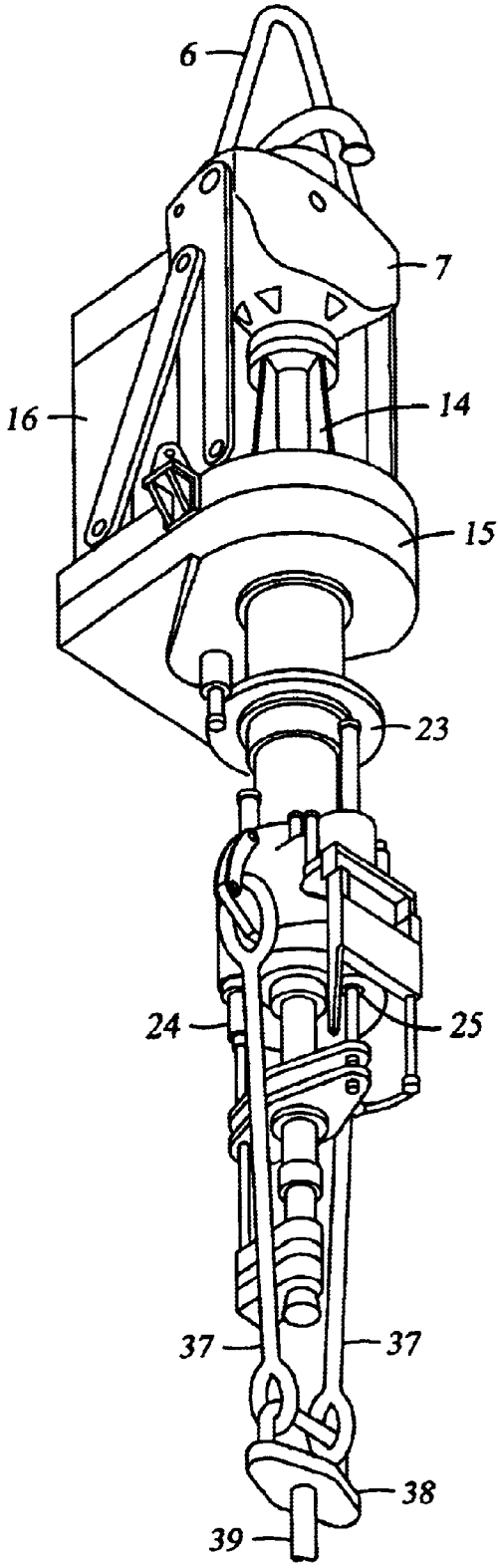
Fig. 12B (PRIOR ART)
FIG. 12B is a perspective view of the top drive of FIG. 12A.

FIGS. 12A and 12B show a typical prior art top drive and derrick (from U.S. Pat. No. 4,593,773 incorporated fully herein for all purposes) with which a continuous circulation system according to the present invention (any disclosed herein) may be used. Systems according to the present invention may be used with any known prior art top drive system.

Methods For Top Drive Rigs

In certain particular methods for "breaking out" tubulars according to the present invention in which a continuous circulation system ("CC") according to the present invention (e.g. as in FIG. 1A or 4) is used in a top drive drilling rig, the top drive is stopped with a joint to be broken positioned within a desired chamber of the CCS or at a position at which the CCS can be moved to correctly encompass the joint. By stopping the top drive, rotation of the drill pipe string ceases and the string is held stationary. A spider is set to hold the string. Optionally, although the continuous circulation of drilling fluid is maintained, the rate can be reduced to the minimum necessary, e.g. the minimum necessary to suspend cuttings. If necessary, the height of the CCS with respect to the joint to be broken out is adjusted if the CCS includes upper and lower BOP's, they are now set. One or more BOP's are optional for all systems according to the present invention.

The drain valve 82 is closed so that fluid may not drain from the chambers of the CCS and the balance valve 84 is opened to equalize pressure between the upper and lower chambers of the CCS. At this point the gate apparatus is open. The valve 76 is opened to fill the upper and lower chambers with drilling fluid. Once the chambers are filled, the valve 76 is closed and the valve 80 is opened so that the pump 74 maintains pressure in the system and fluid circulation to the drill string. The top tong and lower back-up now engage the string and the top drive and/or top tong apply torque to the upper tubular (engaged by the top tong) to break its joint with the top tubular held by the back-up) of the string. Once the joint is broken, the top drive spins out the upper tubular from the top tubular.

The upper tubular (and any other tubulars connected above it) is now lifted so that its lower end is positioned in the upper chamber. The gate is now closed, isolating the upper chamber from the lower chamber, with the top end of the top tubular of the drill string held in position in the lower chamber by the backup (and by the slips).

The valve 78 (previously open to permit the pump to circulate fluid to a drilling swivel DS and from it into the drill string (as shown in FIG. 1B) and the balance valve 84 are now closed. The drain valve 82 is opened and fluid is drained from the upper chamber. The upper BOP's seal is released. The top tong and back-up gripper are released from their respective tubulars and the upper tubular and interconnected tubulars, a "drill stand," (e.g. a drill pipe and/or a stand of a plurality of drill pipes) is lifted with the top drive out from the upper chamber and out from the upper chamber of the CCS while the pump 74 maintains fluid circulation to the drill string through the lower CCS chamber.

An elevator is attached to the drill stand and the top drive separates the drill stand from a saver sub (shown schematically in FIG. 1A). The separated drill stand is moved into the rig's pipe rack with any suitable known pipe movement/manipulating apparatus.

A typical breakout wrench or breakout foot typically used with a top drive is released from gripping the saver sub and is then retracted upwardly, allowing the saver sub to enter a chamber of the system. The saver sub or pup joint is now lowered by the top drive into the upper chamber of the CCS and is engaged by the top tong. The upper BOP is set.

The drain valve 82 is closed, the valve 76 is opened, and the upper chamber is pumped full of drilling fluid. Then the valve 76 is closed, the valve 78 is opened, and the balance valve 84 is opened to balance the fluid in the upper and lower chambers.

The gate is now opened and the top tong is used to guide the saver sub into the lower chamber and then the top drive is rotated to connect the saver sub to the new top tubular of the drill string (whose end is positioned and held in the lower chamber). Once the connection has been made, the top drive is stopped, the valve 80 is opened, the drain valve 82 is opened, and the upper and lower BOP's and the top tong are released. The spider is released, releasing the drill string for raising by the top drive apparatus. Then the break-out sequence described above is repeated.

In a method with the top drive and CCS used for break-out (as described above), the top drive is stopped so that rotation of the drill string ceases. The spider is set to hold the drill string. Optionally, the drilling fluid pump rate is minimized. The height of the CCS and its position with respect to a joint to be made up are adjusted if necessary. The upper and lower BOP's are set. The drain valve 82 is closed, the balance valve 84 is opened, the valve 76 is opened and then closed (once the upper chamber is full. The valve 80 is then opened and the top tong engages the saver sub.

The top drive is activated and reversed to apply some of the torque necessary to break the connection, e.g., between 40% to 90% of the needed torque, and, in certain embodiments between 75% and 90% of the torque needed, and, in one particular aspect, about 75% of the torque needed. The top tong applies the remaining necessary torque to the saver sub. In another aspect the top tong supplies all of the needed torque. The saver sub is then spun out from a top tubular of the drill string by the top drive and lifted, by the top tong and/or top drive, into the upper chamber of the CCS.

The gate is closed to isolate the upper chamber from the lower chamber. The valve 78 is closed, the balance valve 84 is closed and the drain valve 82 is opened to evacuate the upper chamber. During these steps the pump 74 continues to pump drilling fluid to the drill string as it does throughout the process.

The BOP's and top tong and back-up are released. The saver sub is then raised out of the CCS and the top drive itself is then raised within the mast so that the next stand of drill pipe can be picked up. The new stand is then lowered into the CCS and connected to the top tubular of the drill string by rotating the new stand with the top drive. This is done by setting the tong and setting the upper BOP; closing the drain valve 82; opening the valve 76; filling the upper chamber with drilling fluid; closing the valve 76; opening the valve 78; balancing the two chambers by opening the valve 84; applying spin-up torque with the top drive; opening the gate; lowering the lower end of the new stand into the lower chamber; connecting the lower end of the new stand to the top end of the top tubular of the drill string by rotating the top drive.

The valve 80 is then closed, the drain valve 82 is opened, the BOP's are released, the back-up is released; the spider is released; the drill string is lifted as the spider is released and drilling is resume.

Methods For Rotary Table Rigs

In certain methods according to the present invention using a continuous circulation system ("CCS") according to the present invention (as in FIG. 1A), a break-out procedure is begun by removing the kelly from the drill string and then connecting the kelly extension tool joint (with the kelly removed) to the top of the drill string to begin removal of the drill string.

The rotary is stopped and the travelling block is lifted to lift the kelly and the extension tool joint ("ETJ") into position within the CCS. The drawworks brake is set to hold the traveling block stationary and the slips of the rotary table are set to hold the drill string. Optionally, the pumping rate of the continuously circulating drilling fluid (continuously circulated by the CCS throughout this procedure) is minimized. If needed, the position of the CCS is adjusted.

The back-up is energized to engage and hold the drill string and the drain valve 82 is closed. The balance valve 84 is opened and the valve 76 is opened to fill the system's chambers with drilling fluid. Then the valve 80 is opened and the valve 76 is closed. The top tong is energized and engages the ETJ. Rotating the ETJ with the tong separates the ETJ from the drill string, freeing the drill string and apparatus etc. above it.

The kelly is then lifted away from the ETJ and raised into the upper chamber. The chambers are isolated as described above for top drive procedures and the kelly is removed from the CCS and placed to the side, e.g. in a mouse hold. The saver sub (also called "saver pup joint") is disconnected from the kelly (e.g. with manual tongs) and the saver sub (still connected to the kelly and suspended from the traveling block) is swung back over the CCS. The next joint is now lowered into the upper chamber and the top tong engages it. The chambers are filled and balanced as described above for top drive procedures and then the gate is opened and the pin end of the next joint is lowered into the lower chamber where it is then connected, by rotating the tong, to the box end of the top tubular of the dill string whose upper end is in the lower chamber. The main valve 82 is opened, the tong is released; the spider is released; and the drill string is raised until the next tool joint (drill pipe joint) to be broken is correctly positioned in the CCS. This next joint is then broken-out as described above.

To make-up joints with the rotary table/kelly rig, the kelly is disconnected from the drill string within the CCS while the pump 74 continuously supplies drilling fluid to the drill string. The kelly is then removed from the CCS by raising the traveling block.

The saver sub is then re-connected to the kelly (e.g. using a kelly spinner and manual tongs). The kelly is then raised with the traveling block above the CCS and lowered into its upper chamber. The top tong engages the kelly and connects it to the top tubular of the drill string within the lower chamber of the CCS, all while drilling fluid is continuously provided to the drill string by the CCS.

With the kelly connected to the drill string, the rotary rotates the kelly to resume drilling.

In certain aspects when a system according to the present invention as described above is used offshore with a top drive rig, the cylinders of the frame (which is connected to the rig floor) serve the function of heave compensators. A typical heave compensation system interfaces with the cylinders (e.g. the cylinders 16, FIG. 1A or FIG. 4A) causing the cylinders to react (the pistons move) to compensate for heaving of the rig.

Figure 4C:
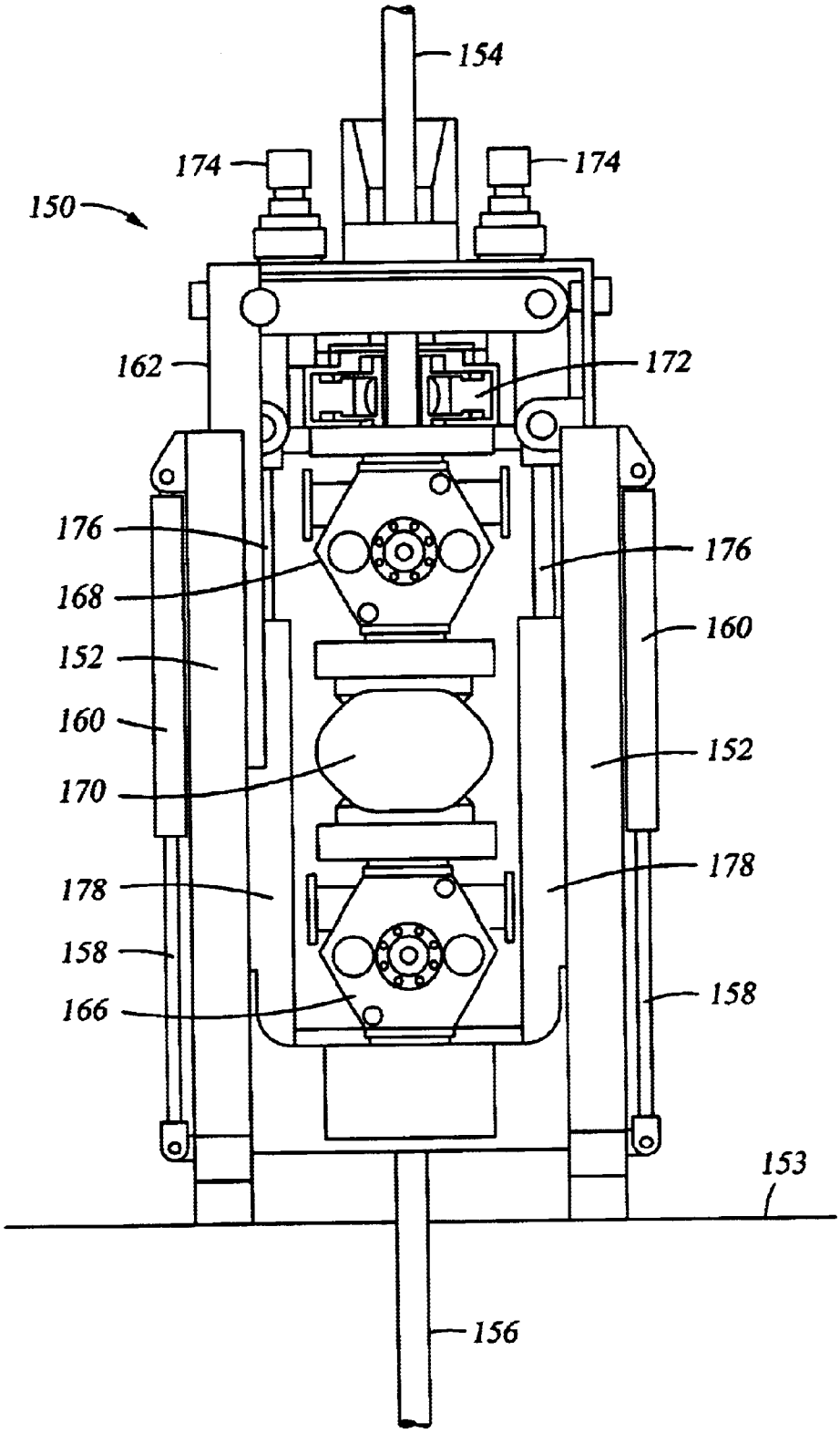
Figure 13A:
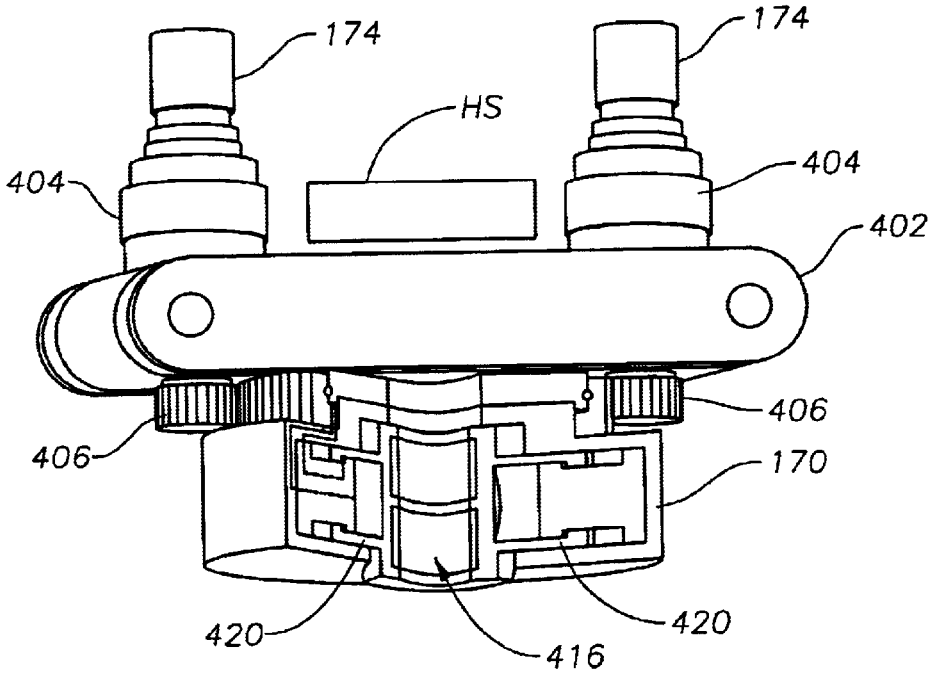
FIG. 13A is a perspective view of a tong and motors according to the present invention.
Figure 13B:
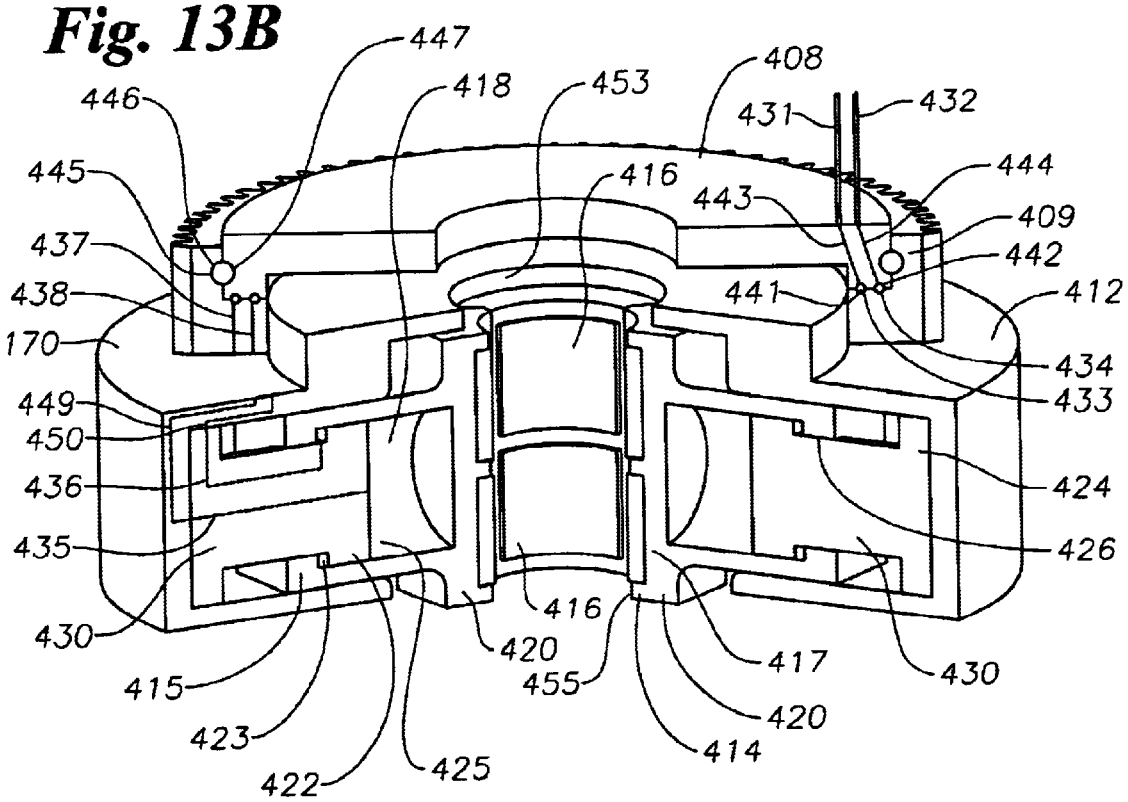
FIG. 13B is a cutaway view of the tong of FIG. 13A.

FIGS. 13A–13B show one embodiment of a tong 170 with motors 174 (as shown in FIGS. 4A–4C above). As shown in FIG. 13A, an optional hydraulic swivel HS may be used with a tong 170 or, as discussed below, hydraulic fluid under pressure used by the tong may be supplied via lines within the tong itself through hoses connected to the tong. The hydraulic swivel HS, when used, may be located at any appropriate location, although it is shown schematically in FIG. 13A above the tong.

The tong motors 174 are supported by a frame 402. It is within the scope of this invention to use any suitable motor, including, but not limited to, air motors and hydraulic motors. In certain aspects the motors are low speed high torque motors without a gear box. In other aspects, as shown in FIG. 13A, the motors are high-speed low torque motors with associated planetary gear boxes 404 and drive gears 406.

Figure 13C:
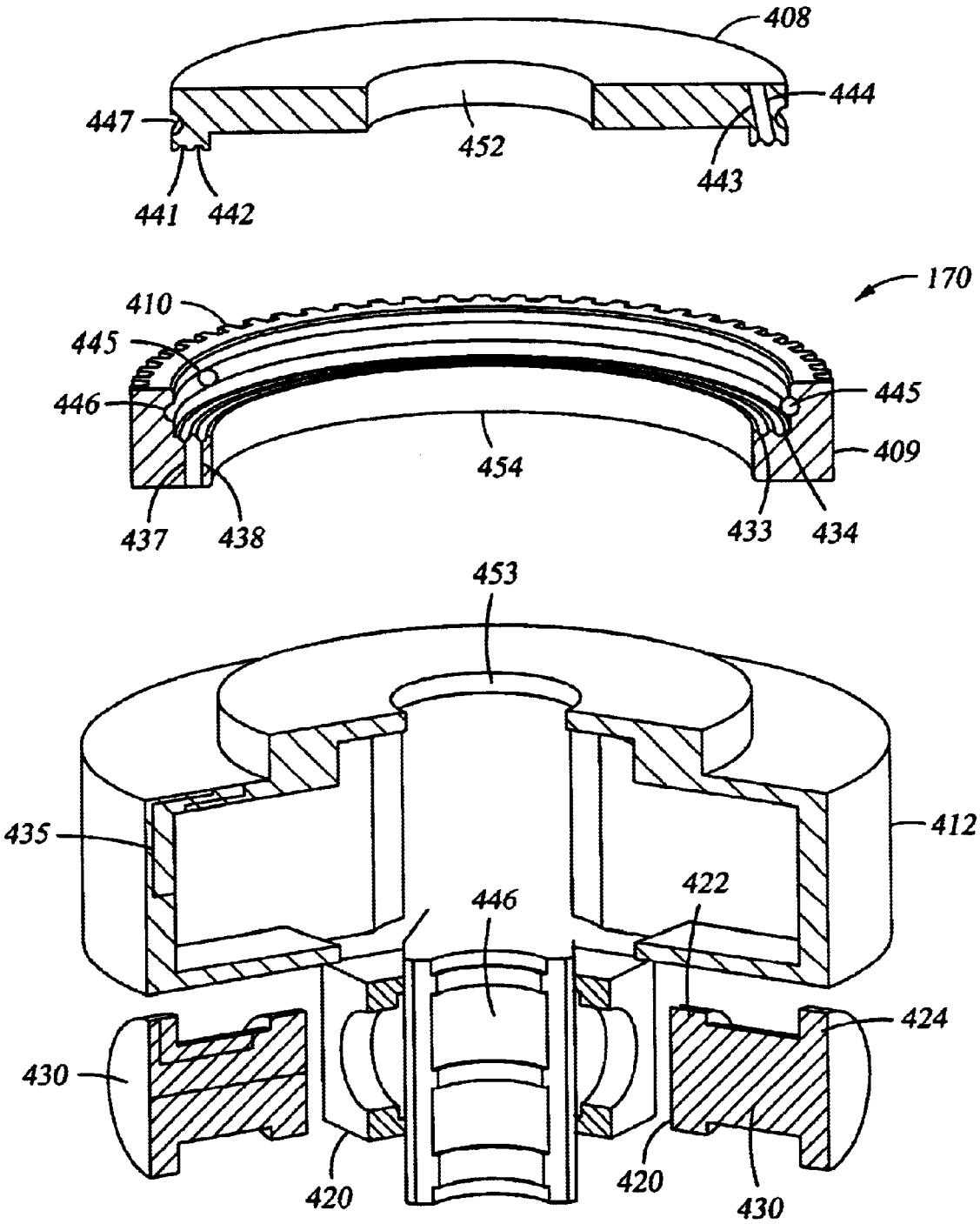
FIG. 13C is an exploded view of the tong of FIG. 13A.

The tong 170 as shown in FIGS. 13A–13C has a gear flange 408 movably mounted on a gear wheel 409 with teeth 410 that mesh with teeth of the gears 406 for rotating the tong 170. Rotating the gear wheel 409 rotates a housing 412 to which the gear wheel 409 is secured.

A hollow interior of the housing 412 contains three jaw assemblies 420 (two shown) each with a jaw 414 having a gripping insert or inserts 416 releasably secured to an end 417 thereof. It is within the scope of this invention to have two, three, four or more jaw assemblies 420 around the circumference of the housing 412. It is within the scope of this invention to use any suitable known gripping inserts for the inserts 416, including, but not limited to, inserts as disclosed in U.S. Pat. Nos. 5,221,099; 5,451,084; 3,122,811 and in the references cited in each of these patents—all of which patents and references are incorporated fully herein for all purposes. The inserts 416 may be secured to and/or mounted on the jaws 414 by any known means or structure.

Each jaw 414 has an inner chamber 418 in which is movably disposed an end 422 of a piston 430. Another end 424 of each of the pistons 430 is movably disposed in the housing 412. The piston 430 has a central portion that sealingly extends through a channel 426 in the jaw 414. As is described in detail below, pumping fluid into a space 425 in the chamber 418 between the piston end 422 and the jaw end 417 moves the jaw and its insert into contact with a tubular within the tong. Pumping fluid into the chamber 418 on the other side of the piston end 422, a space 423 between the piston end 422 and an outer wall 415 of the jaws 414, moves the jaw out of engagement with a tubular in the tong.

Fluid under pressure is provided to the chamber 418 via "flow line 435 into the space 423 and via a flow line 436 into the space 425. Fluid is provided to these lines via lines 449, 450 in the housing 412. Of course the extent of the spaces 423, 425 changes as the piston 430 moves. Fluid is supplied to the flow lines 449, 450 via holes 437, 438 in the gear wheel 409. There is a set of such lines (449, 450) and holes (437, 438) for each jaw assembly. The holes 437, 438 are in fluid communication with grooves 433, 434 in the gear wheel 409 and corresponding grooves 441, 442 in the gear flange 408. Fluid is pumped through hoses 432 (e.g. in fluid communication with a typical rig hydraulic-fluid-under-pressure supply system) to channels 443, 444, which are in fluid communication with the grooves 433, and 434, respectively. This fluid is continuously supplied to the jaw assemblies through the tong. Alternatively, an apparatus is provided on or in the gear flange for selectively providing fluid under pressure to the lines 449, 450 of each jaw assembly.

The gear flange 408 is movable with respect to the gear wheel 409 so that as the gear wheel 409 and housing 412 are rotated by the motors 174, the gear flange 408 can remain substantially stationary. A plurality of bearings 445 in grooves 446 and 447 facilitate rotation of the gear wheel 409 with respect to the gear flange 408.

A tubular within the tong 170 extends through a channel 452 in the gear flange 408 through a channel 454 in the gear wheel 409, through a channel 453 in the housing 412, and in the space between the outer surfaces of the inserts 416 and a channel 455 defined by a lower inner edge of the jaws 414.

In certain embodiments the inserts 416 of the tong 170 are "bi-directional" inserts or dies designed for handling torsion and axial loading. It is within the scope of this invention to use any suitable known inserts and/or dies for slips and/or tongs for the inserts 416, including, but not limited to inserts as shown in U.S. Pat. No. 5,451,084 and in the prior art cited therein. FIG. 14A shows an insert 460 for use as the inserts 416 which is similar to the inserts of U.S. Pat. No. 5,451,084, incorporated fully herein for all purposes. The insert 460 has a body 461 with a plurality of recesses 462 in each of which is secured a gripper bar 464 made, e.g., of metals such as steel, stainless steel, brass, bronze, aluminum, aluminum alloy, zinc, zinc alloy, titanium, copper alloy, nickel-based alloy, cermet, ceramic or a combination thereof, each bar with a plurality of teeth 466 for engaging a tubular in the tong 170. In one aspect the body 461 is plastic, rubber, urethane, polyurethane or elastomeric material. FIG. 14B shows one particular configuration and profile for teeth 465 of a gripper bar 467 which can be used for the gripper bars 464. FIG. 14C shows two inserts 416 of a jaw assembly 420 engaging a tubular TB (one side shown) in a tong 170 (not shown). The structure of the tong 170 as shown in FIGS. 13A–13C including the gear flange, the gear wheel, the bearings, and the jaw assemblies (jaws, pistons), also contributes to the tong's ability to withstand an axial force applied to a tubular held by the tong, e.g. an axial force applied to the tubular by fluid under pressure in a chamber of a circulation system according to the present invention as described herein.

FIGS. 15A–15G illustrate a system 500 according to the present invention and steps in a method according to the present invention. The system of FIG. 1A uses one set of cylinders to move the tong with respect to the upper chamber and another set of cylinders to move the frame with respect to the pedestal. In the system 500 a single cylinder/piston moves a tong 503 and an upper chamber 532 in unison, eliminating the need for a second set of cylinders.

A cylinder 511 with a movable piston 519 has a lower end mounted on a base 501. The piston's upper end is fixed to a first plate 551 which is secured to a hollow post 552. The upper chamber 532 is secured to a second plate 553 which is also secured to the post 552. The tong 503 is above a third plate 554 and beneath and secured to a fourth plate 555 which is secured to the post 552. Both plates 554 and 555 are secured to the post 552.

The post 552 is movable up and down by the cylinder 511/piston 519. The post 552 is hollow and moves on a tube 502 secured to the base 501. In one aspect the tube 502 and the post 552 are non-round to resist torsion and/or bending.

A lower chamber 531 is mounted on or secured to the first plate 551. A spider 536 (e.g. but not limited to commercially available flush-mounted spiders) with slips 537 acts as the lower gripper or back-up. The spider 536 is mounted on a rig (not shown) as is the system shown in FIG. 1A. A main gate apparatus 506 acts as does the gate of the system in FIG. 1A and control heads 561, 562 are like the control heads of the system of FIG. 1A. The movable sabot or inner bushing of the system of FIG. 1A may be used with the system 500.

A kelly bushing 538 with rollers 539 facilitates movement of the kelly 509.

Figure 15A:
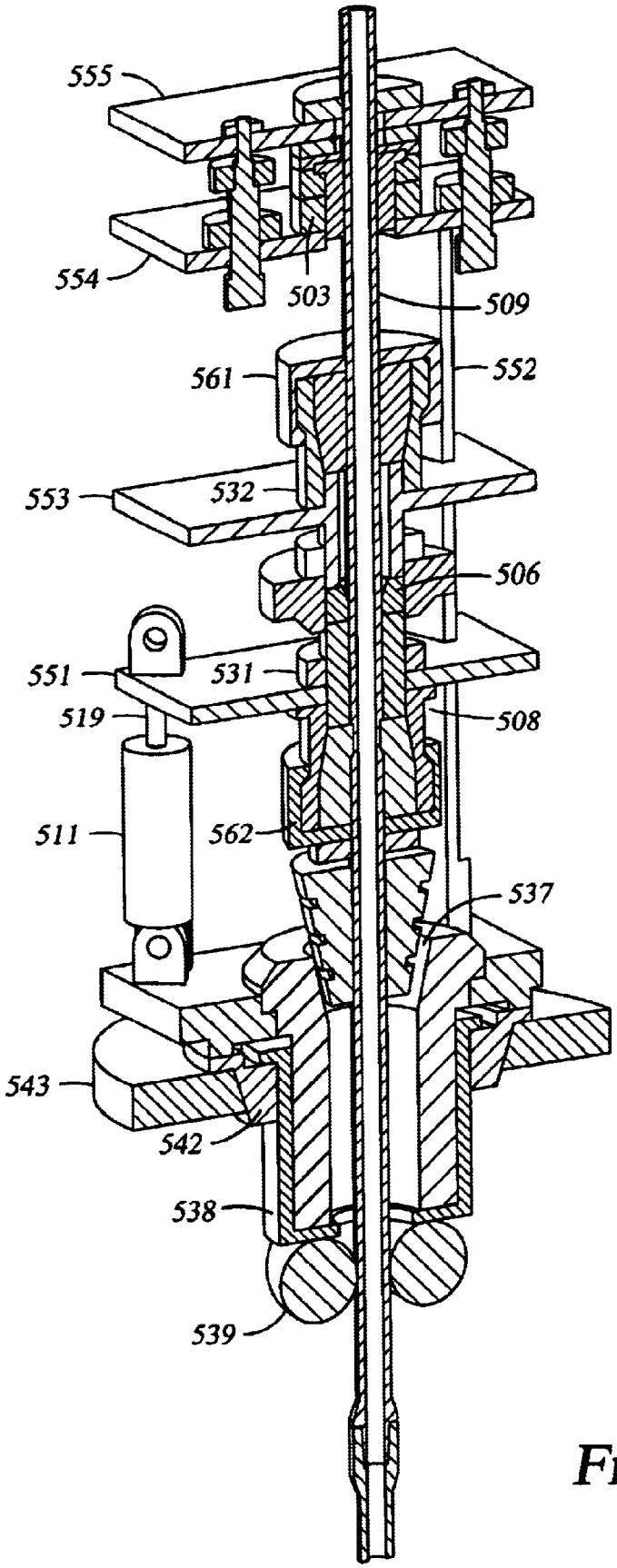
FIGS. 15A–15G illustrate steps in a method according to the present invention using a continuous circulation system according to the present invention.
Figure 15B:
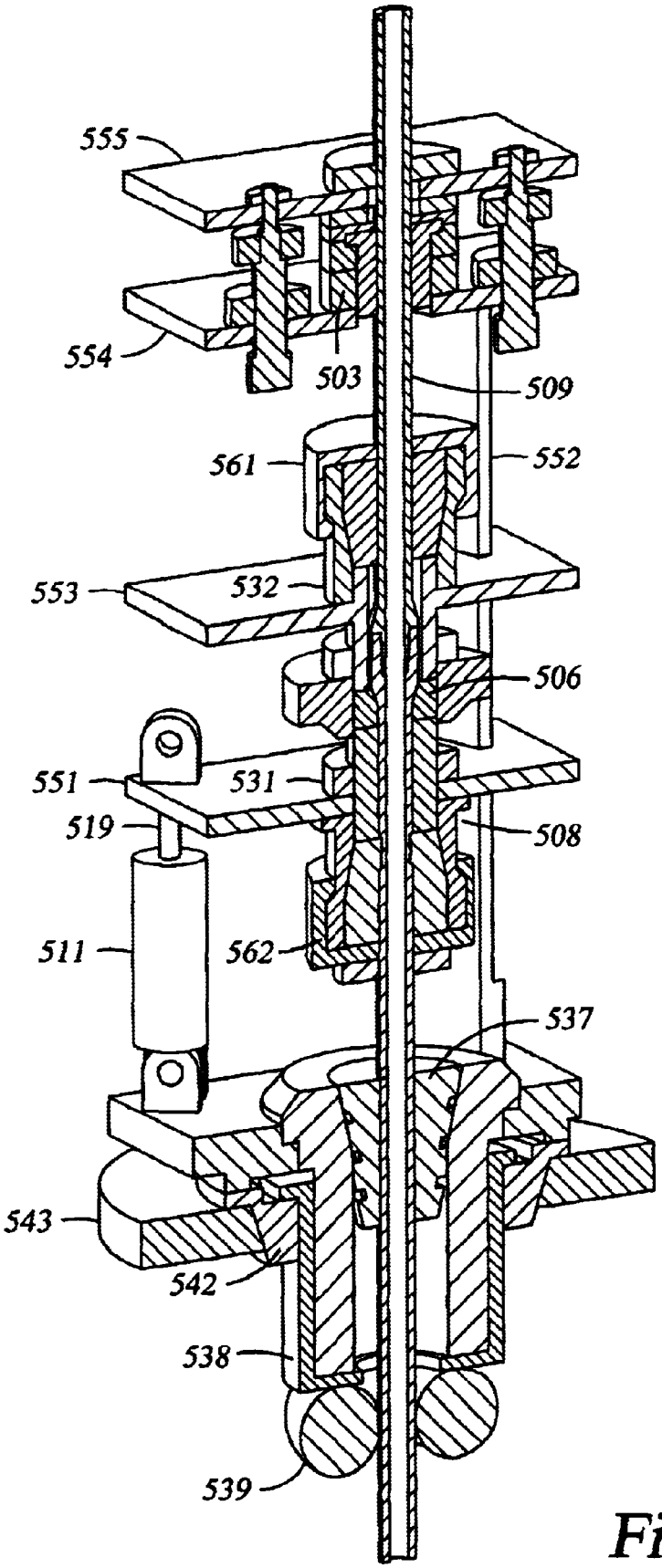
Figure 15C:
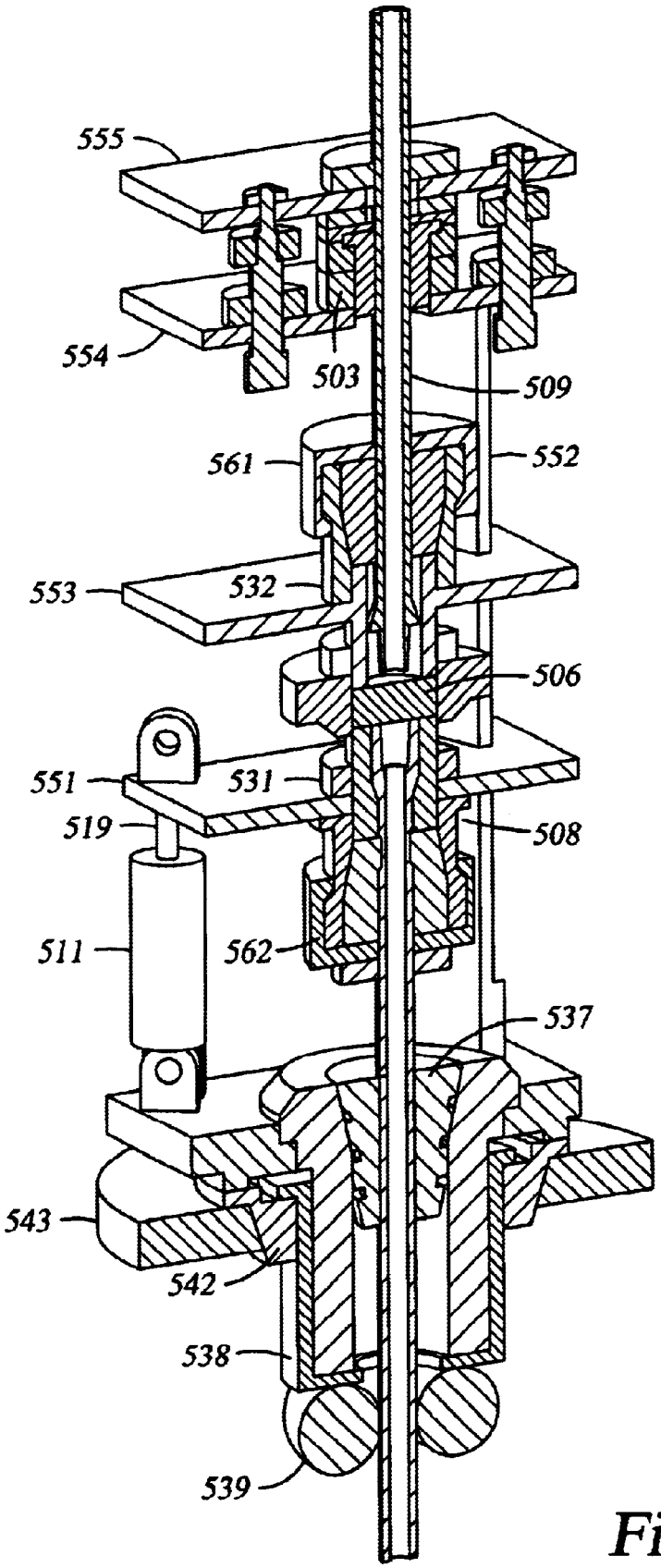
Figure 15D:
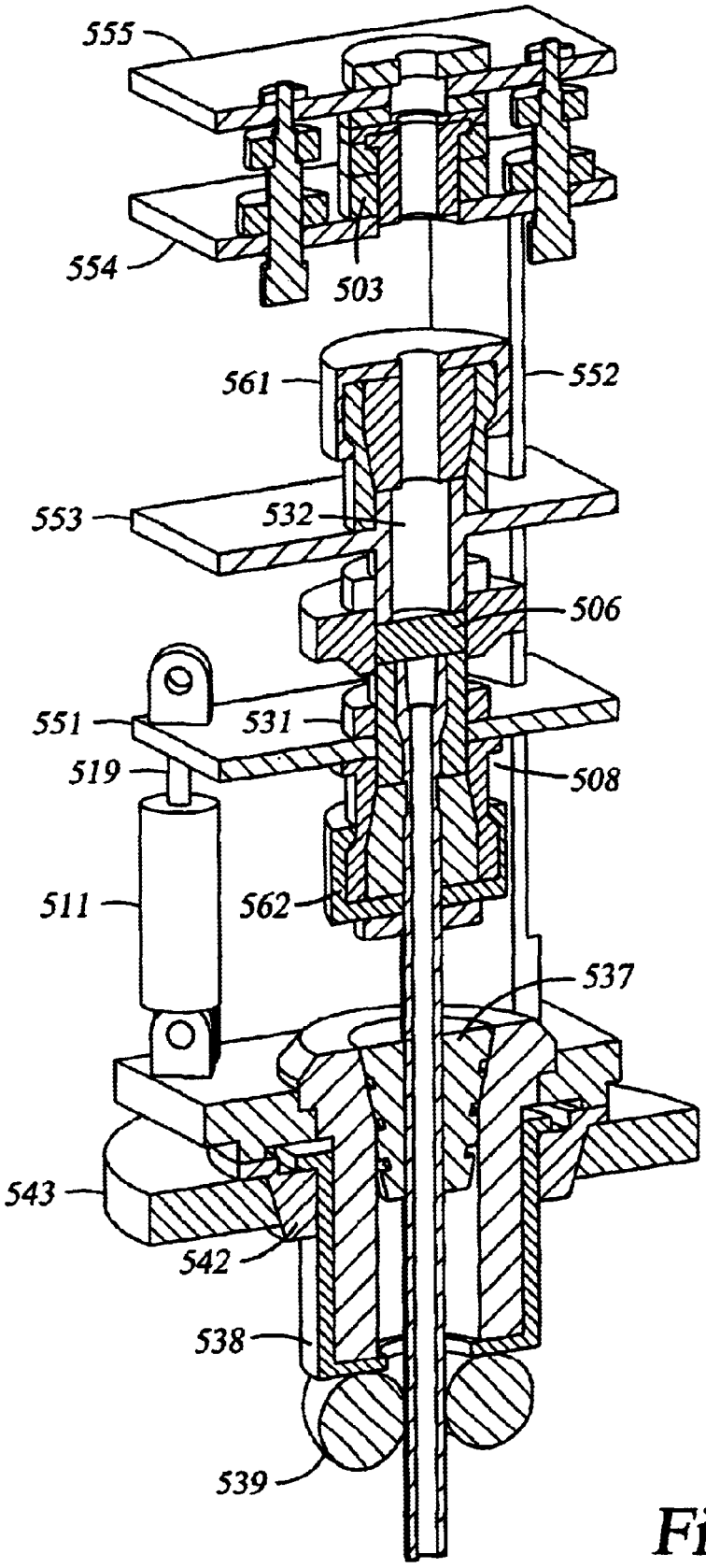

As shown in FIG. 15A a kelly 509 is connected to a top joint 508 of a drill string. In FIG. 15B, the kelly 509 has been raised (e.g. by suitable means as discussed for the system of FIG. 1A) so that the kelly/tool joint connection is in the upper chamber 532. The tool joint portion of the kelly 509 is gripped by the tong 503 and the upper chamber is filled with fluid while continuous fluid circulation is maintained, e.g. with a system as in FIG. 1B. The drill string is gripped by the slips 537 of the spider 538. Using the tong 503, the connection is broken in the upper chamber. As the connection is being broken and the kelly is being separated from the top joint of the drill string, the tong 503 (and kelly) is moved up by extension of the piston 519, which also moves the upper chamber up. The piston 519/cylinder 511 is controller and powered by the system's control system, e.g. as in the system of FIGS. 1A, 1B. The movement of the tong and of the upper chamber moves the lower chamber 531 around the top end of the top tool joint of the drill string. The gate 506 is closed (FIG. 15C), the tong 503 is released and the kelly 509 is removed from the upper chamber 532 (FIG. 15D). Fluid circulation to the drill string is maintained during all these steps as in the system of FIG. 1A.

Figure 15E:
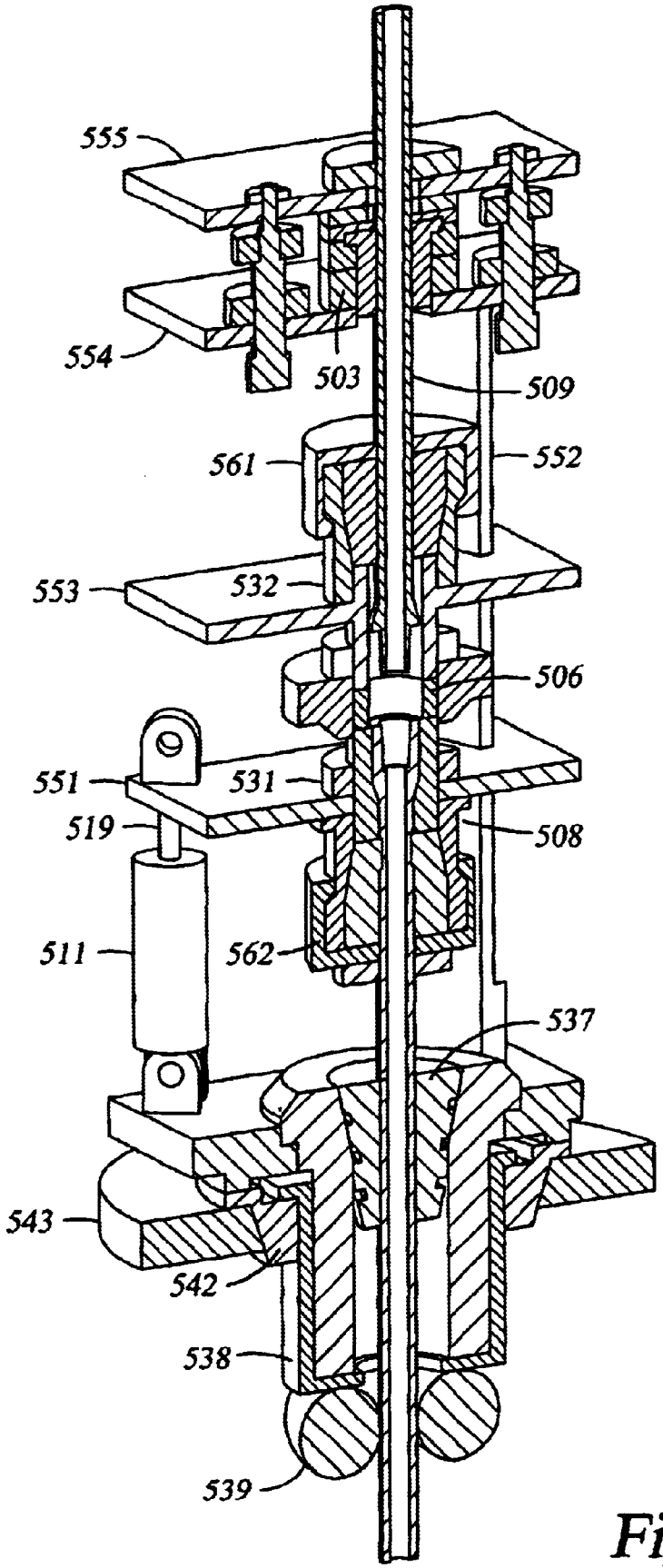
Figure 15F:
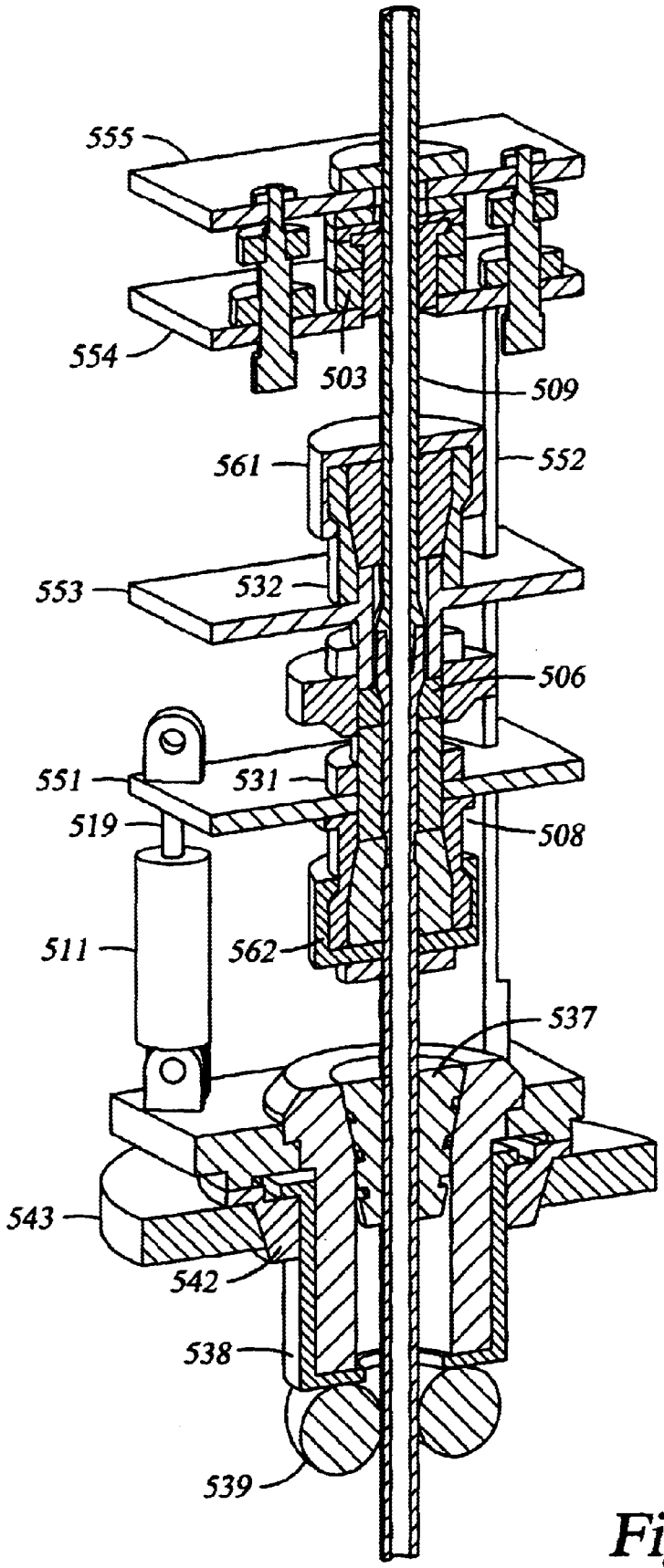
Figure 15G:
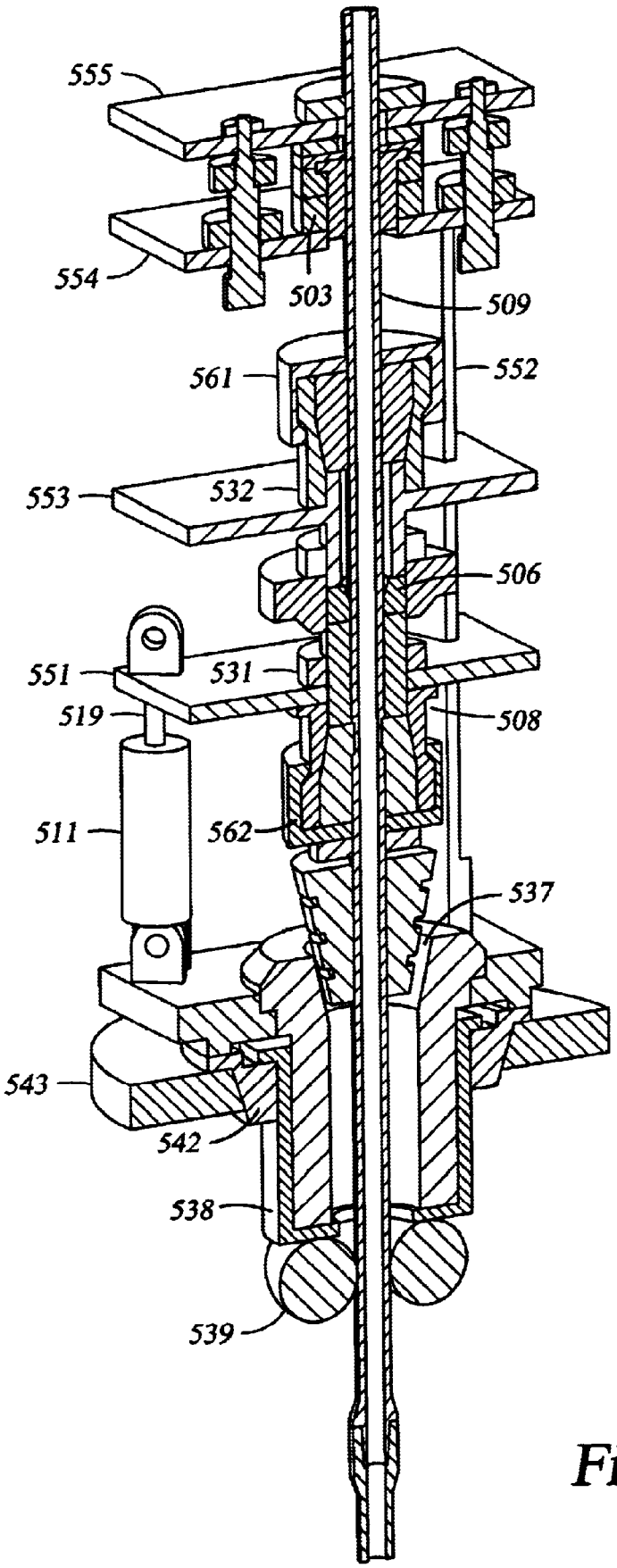

As shown in FIG. 15E, the lower end of a new tool joint 570 (connected to the kelly—not shown in FIG. 15E) has been introduced through the tong 503 into the upper chamber 532. The gate 506 is opened. The piston 519 is retracted lowering the tong 503 and the upper chamber 532 so that the top end of the drill string enters the upper chamber 532. The tong 503 grips the tool joint 570 (FIG. 15G) and makes-up the connection. Fluid is continuously circulated to the drill string throughout the method as in the system of FIG. 1A.

Figure 16A:
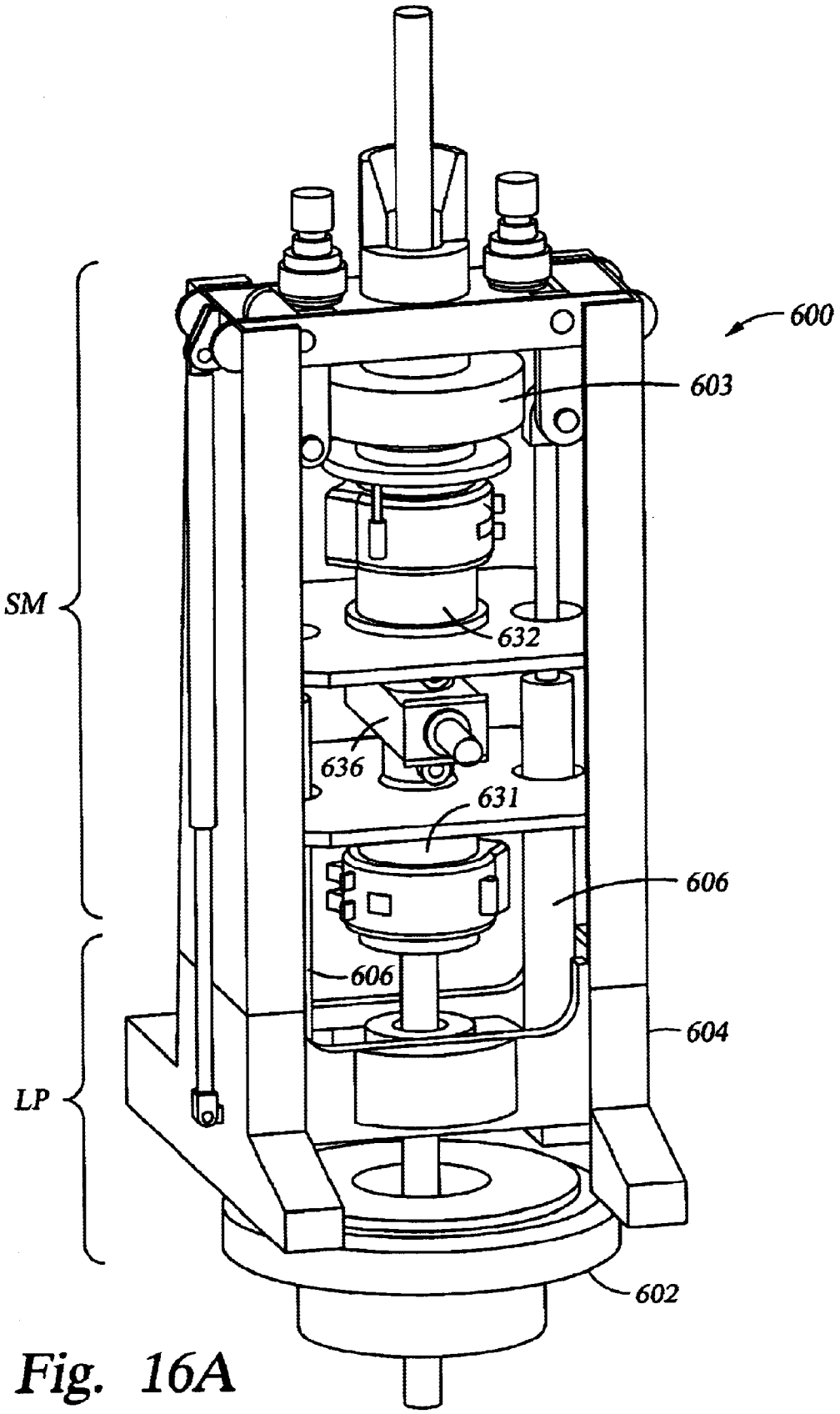
FIG. 16A is a perspective view of a system according to the present invention.
Figure 16B:
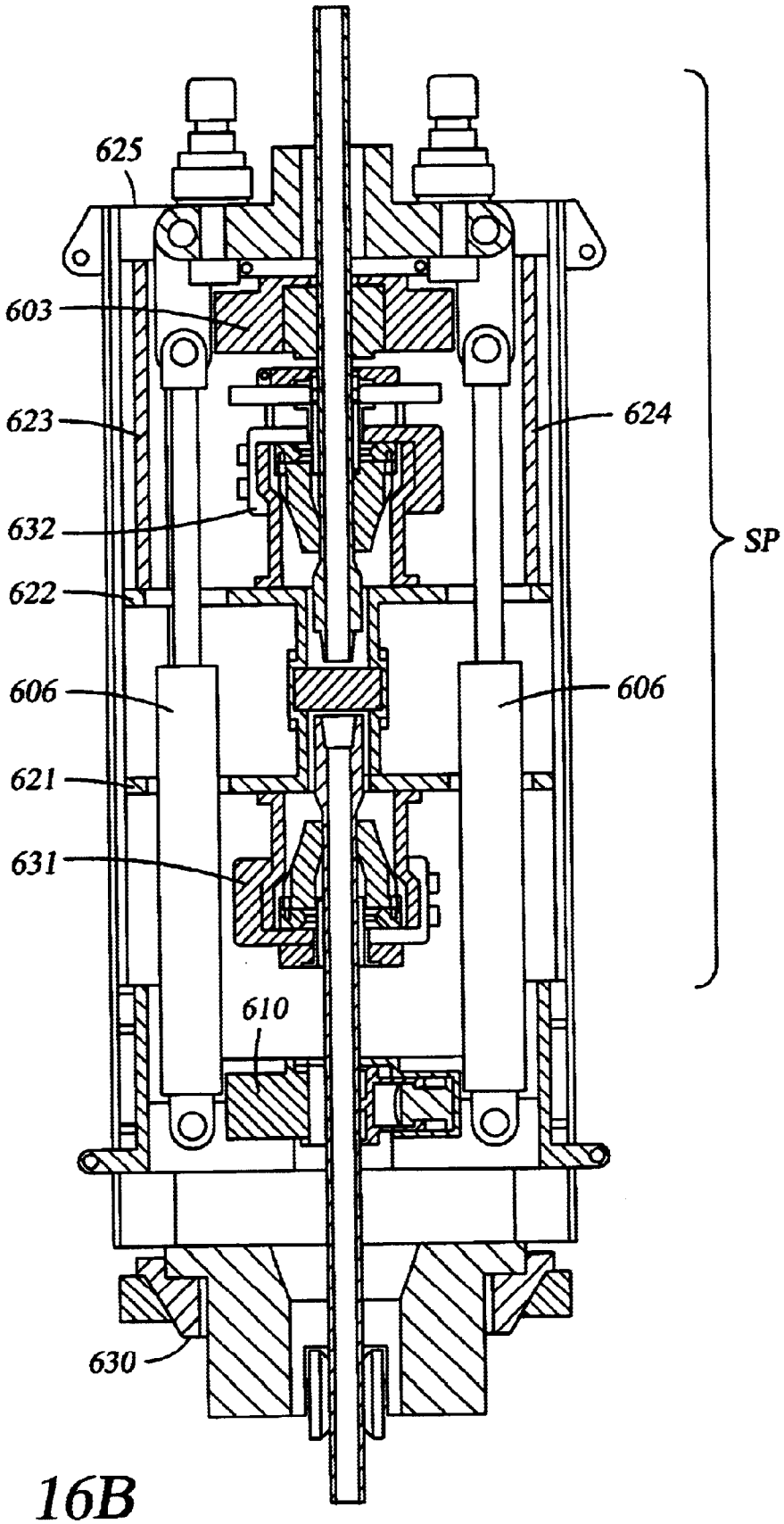
FIG. 16B is a cross-section view of the system of FIG. 16A.

FIGS. 16A and 16B show a system 600, like the system of FIG. 4A, but with the side cylinders 160 deleted. The system 600 has a new kelly bushing 602 (like the kelly bushing of FIG. 10A). A pedestal 604 is mountable on a track on a rig (not shown) e.g. as a prior art "Iron Roughneck" is mounted on a track on a rig.

As shown in FIG. 16A a system module SM may be releasably secured to a lower portion LP of the pedestal 604 so that the module SM is selectively removable from and emplaceable on the pedestal lower portion. A single set of selectively operable cylinders 606 is mounted to a frame 608 for moving the system portion SP. Upper chamber 632, lower chamber 631 and tong 603 (like the tong 172, FIG. 4A) are interconnected by plates 621, 622, 625 and members 623, 624. A back-up gripper 610 is like the back-up 72 of FIG. 1A. The chambers 632, 631 are like the upper and lower chambers of previously-described systems herein with the same sabots, control heads, sealing apparatus and control system. A kelly bushing 630 is like that of FIG. 1A. A gate apparatus 636 is like that of previously-described systems.

The present invention, therefore, provides in some, but not necessarily all, embodiments a system for continuously circulating fluid to and through a hollow tubular string while an upper hollow tubular is added to or removed from a top of the tubular string, the system including chamber apparatus with a bottom opening, a top opening and sealing apparatus for sealingly encompassing a portion of the top of the tubular string, the chamber apparatus sized for accommodating connection and disconnection therein of the upper hollow tubular to the top of the tubular string, apparatus for isolating the upper hollow tubular with a portion in the chamber apparatus from fluid pressure loading within the chamber apparatus. Such a method may have one or some (in any possible combination) of the following: gate apparatus; wherein the hollow tubular string is coiled tubing; wherein the hollow tubular string is made up of a plurality of hollow tubulars connected end-to-end each having a top-to-bottom fluid flow channel therethrough; and/or wherein the hollow tubular string is a drill string.

The present invention, therefore, provides in some, but not necessarily all, embodiments a tong for use in wellbore operations, the tong having a housing with a hollow interior, a gear wheel secured to the housing for rotation therewith, the gear wheel having a toothed outer circumference for mating with teeth of a drive shaft of a driving motor, a gear flange mounted on top of the gear wheel so that rotation of the gear wheel does not rotate the gear flange, and a plurality of spaced-apart jaw assemblies within the housing's hollow interior, each jaw assembly having a jaw for selectively engaging a portion of a tubular to be gripped and rotated by the tong. Such a tong may have one or some (in any possible combination) of the following: fluid flow apparatus for selectively conveying operating fluid under pressure through the tong to the jaw assemblies for selectively operating the jaw assemblies; wherein the plurality of spaced-apart jaw assemblies is three spaced-apart jaw assemblies; wherein each jaw assembly of the plurality of jaw assemblies has at least one insert thereon for engaging the tubular; wherein the inserts are toothed inserts; wherein the inserts are configured for resisting both axial and radial loading; wherein each jaw assembly has a jaw body with an inner chamber having an outer wall with a channel therethrough, a piston with a first end in the inner chamber, the first end secured to or formed of an intermediate portion movable in the channel of the outer wall of the inner chamber, and a first end, and a second end secured to or formed of the intermediate portion, the second within the housing of the tong, and the jaw body selectively movable with respect to the piston into and out of engagement with the tubular by selectively applying fluid under pressure on one side of the first end of the piston; a plurality of bearings between the gear flange and the gear wheel for facilitating movement of the gear wheel with respect to the gear flange; and/or wherein the tong's gear flange, gear wheel, jaw assemblies and bearings are configured and sized to resist axial loading on the tong.

The present invention, therefore, provides in some, but not necessarily all, embodiments a tong for use in wellbore operations, the tong having a housing with a hollow interior, a plurality of jaw assemblies movably mounted in the hollow interior of the housing, gear structure on the housing for mating co-action with a tong drive apparatus, and internal fluid flow apparatus for conducting fluid under pressure through the tong to the jaw assemblies for selectively operation of the jaw assemblies for engaging and disengaging from a tubular to be gripped and rotated by the tong.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps.

What is claimed is:

1. A tong for use in wellbore operations, the tong comprising:

a housing with a hollow interior;

a gear secured to the housing, the gear having a toothed portion for mating with teeth of a drive shaft of a driving motor;

a gear flange mounted on top of the gear so that rotation of the gear does not rotate the gear flange;

one or more bearings disposed between the gear flange and the gear for dissipating stress when the gear and the gear flange are moved axially relative to each other; and a plurality of spaced-apart jaw assemblies within the housing's hollow interior, each jaw assembly having a jaw for selectively engaging a portion of a tubular to be gripped and rotated by the tong, wherein each jaw assembly and the one or more bearings are configured for resisting both axial and radial loading.

2. The tong of claim 1, wherein each jaw assembly further comprises at least one toothed insert, the at least one toothed insert being used by each jaw to engage the tubular.

3. The tong of claim 2, wherein the plurality of spaced-apart jaw assemblies defines three spaced-apart jaw assemblies.

4. The tong of claim 1, wherein the bearings between the gear flange and the gear facilitate the movement of the gear with respect to the gear flange.

5. The tong of claim 2, wherein the tong's gear, gear flange, jaw assemblies and bearings are configured and sized to resist axial loading on the tong.

6. The tong of claim 5, further comprising fluid flow apparatus for selectively conveying operating fluid under pressure through the tong to the jaw assemblies for selectively operating the jaw assemblies into and out of engagement with the tubular.

7. The tong of claim 6, wherein each jaw assembly further comprises:

a jaw having a first end, a second end, and a chamber wall therebetween, the first end being sealed by a face, and the second end having an opening therein;

a chamber defined within the chamber wall of the jaw;

a piston having a first end within the chamber of the jaw, the first end of the piston being movable within the chamber by selectively applying fluid under pressure on one side of the first end of the piston, and a second end external to the jaw but being secured within the housing of the tong;

and wherein the toothed insert is disposed adjacent the face of the jaw and external to the chamber for engaging the tubular when the jaw is actuated, the insert being configured for resisting both axial and radial loading.

8. A tong for use in wellbore operations, the tong comprising:

a housing with a hollow interior;

a plurality of jaw assemblies, at least one of which is movably mounted in the hollow interior of the housing for selectively engaging a portion of a tubular to be gripped and rotated by the tong, the jaw assemblies configured to resist both axial and rotational movement of the tubular upon engagement therewith;

a gear structure on the housing for mating co-action with a tong drive apparatus;

a gear retention member for axially retaining the gear structure; and a bearing between the gear retention member and the gear structure for facilitating movement of the gear structure with respect to the gear retention member and for dissipating axial stress when the gear structure and the gear retention member are moved axially relative to each other.

9. The tong of claim 8, wherein each of the jaw assemblies further comprises an insert having teeth to aid in resisting both axial and rotational movement of the tubular upon engagement therewith.

10. The tong of claim 9, wherein the gear retention member and the bearing are sized and configured to resist axial loading.

11. The tong of claim 10, wherein the plurality of jaw assemblies defines three spaced-apart jaw assemblies.

12. The tong of claim 11, further comprising internal fluid flow apparatus for conducting fluid under pressure through the tong to the jaw assemblies for selective operation of the jaw assemblies for engaging and disengaging the tubular.

13. The tong of claim 10, wherein said tong is used as part of a system for continuously circulating fluid to and through a tubular string while an upper tubular is connected or disconnected from a top tubular of the tubular string, the system comprising:

an upper chamber for receiving the upper tubular of the tubular string, said upper chamber having a bottom opening and a top opening;

a lower chamber for receiving the top tubular of the tubular string, said lower chamber having a bottom opening and a top opening, one of said upper chamber and said lower chamber sized for accommodating connection and disconnection therein of the upper tubular and the top tubular by the tong;

an upper sealing apparatus within said upper chamber for sealingly encompassing a portion of the upper tubular within said upper chamber;

a lower sealing apparatus within said lower chamber for sealingly encompassing a portion of the top tubular within said lower chamber; and an apparatus for isolating the upper chamber from fluid pressure loading within the lower chamber during connection or disconnection of the upper tubular and the top tubular.

14. The tong of claim 13, wherein the tong isolates the upper tubular from fluid pressure loading within the upper chamber.

15. A method for rotationally connecting two threaded tubulars, wherein at least one of the tubulars is subjected to an axial force created by a fluid pressure acting over at least a portion of a cross-sectional area of the at least one tubular, comprising the steps of:

providing a tong which is sized and configured to withstand the axial force, the tong having:

a housing with a hollow interior; and a plurality of jaw assemblies, at least one of which is movably mounted in the hollow interior of the housing for selectively engaging a portion of the at least one tubular;

gripping the at least one tubular with the tong;

rotating the at least one tubular with the tong, thereby relatively manipulating the threads between the two tubulars; and dissipating axial stress through a bearing.

16. The method of claim 15, wherein providing a tong comprises providing a tong having:

a gear structure on the housing for mating co-action with a tong drive apparatus;

a gear retention member for axially retaining the gear; and wherein the bearing between the gear retention member and the gear for facilitating movement of the gear with respect to the gear retention member, and wherein the bearing and the plurality of jaw assemblies are configured to resist both axial and rotational movement of the at least one tubular upon engagement therewith.

17. The method of claim 16, wherein providing a tong further comprises providing each of the jaw assemblies with an insert having teeth to aid in resisting both axial and rotational movement of the at least one tubular upon engagement therewith.

18. The method of claim 17, wherein the gear retention member and the bearing are sized and configured to resist axial loading.

19. The method of claim 18, wherein the plurality of jaw assemblies defines three spaced-apart jaw assemblies.

20. The method of claim 19, wherein providing a tong further comprises providing a tong having an internal fluid flow apparatus for conducting fluid under pressure through the tong to the jaw assemblies for selective operation of the jaw assemblies for engaging and disengaging from the tubular to be gripped and rotated by the tong.

21. The tong of claim 1, wherein each jaw assembly comprises a piston having one end disposed within a chamber of a jaw.

22. The tong of claim 21, further comprising supporting the jaw with a plurality of support surfaces to resist axial loading.

23. The tong of claim 22, wherein the plurality of support surfaces comprises a first contact surface between the piston and the jaw and a second contact surface between the jaw and the housing.

24. A system for continuously circulating fluid to and through a tubular string while an upper tubular is connected or disconnected from a top tubular of the tubular string, the system comprising:

a tong having:

a housing with a hollow interior;

a gear secured to the housing, the gear having a toothed portion for mating with teeth of a drive shaft of a driving motor;

a gear flange mounted on top of the gear so that rotation of the gear does not rotate the gear flange; and one or more bearings disposed between the gear and the gear flange; and a plurality of spaced-apart jaw assemblies within the housing's hollow interior, each jaw assembly having a jaw for selectively engaging a portion of a tubular to be gripped and rotated by the tong, wherein each jaw assembly and the one or more bearings are configured for resisting both axial and radial loading;

an upper chamber for receiving the upper tubular of the tubular string, said upper chamber having a bottom opening and a top opening;

a lower chamber for receiving the top tubular of the tubular string, said lower chamber having a bottom opening and a top opening, one of said upper chamber and said lower chamber sized for accommodating connection and disconnection therein of the upper tubular and the top tubular by the tong;

an upper sealing apparatus within said upper chamber for sealingly encompassing a portion of the upper tubular within said upper chamber;

a lower sealing apparatus within said lower chamber for sealingly encompassing a portion of the top tubular within said lower chamber; and an apparatus for isolating the upper chamber from fluid pressure loading within the lower chamber during connection or disconnection of the upper tubular and the top tubular.

25. The system of claim 24, wherein the tong isolates the upper tubular from fluid pressure loading within the upper chamber.

* * * * *